US006502052B1

(12) United States Patent
Someya et al.

(10) Patent No.: US 6,502,052 B1
(45) Date of Patent: Dec. 31, 2002

(54) NOTE BUNDLE MANAGING APPARATUS TO STORE AND COUNT NOTE BUNDLES

(75) Inventors: Seiichi Someya, Kawasaki (JP); Yasuo Shinohara, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/249,199

(22) Filed: Feb. 12, 1999

(30) Foreign Application Priority Data

Feb. 19, 1998 (JP) ..... 10-037545
Feb. 20, 1998 (JP) ..... 10-038768

(51) Int. Cl.[7] ..... B07C 5/10
(52) U.S. Cl. ..... 702/128; 702/172; 235/379
(58) Field of Search ..... 702/128, 127, 702/33, 40, 150, 152, 159, 163, 170, 172, 183, 158, FOR 123, FOR 124, FOR 134, FOR 140, FOR 144, FOR 146, FOR 148, FOR 170; 53/53, 52; 209/534, 536, 538, 551, 548; 250/222.2, 223 R, 556; 356/71, 434, 435; 382/135; 902/12, 13, 8, 9, 20, 21; 194/206, 207; 235/379, 375; 705/43, 42; 221/195, 13, 21; 700/242; 377/8, 14, 17, 19, 1; 271/3.01, 9.01

(56) References Cited

U.S. PATENT DOCUMENTS 4,462,506 A * 7/1984 Ohba ..... 221/13
4,772,781 A * 9/1988 Watanabe ..... 235/379
4,845,917 A * 7/1989 Omura et al. ..... 53/53
5,012,932 A * 5/1991 Omura et al. ..... 209/534
5,017,773 A * 5/1991 Sato ..... 250/223 R
5,022,531 A * 6/1991 Horino et al. ..... 209/534
5,090,573 A * 2/1992 Takahashi et al. ..... 209/534
5,522,511 A * 6/1996 Sakoguchi et al. ..... 902/12

FOREIGN PATENT DOCUMENTS

JP 8-96210 4/1996
JP 8-96210 A * 4/1996

OTHER PUBLICATIONS

Shirakawa et al., Translation of JP–8–96210–A, Apr. 1996.*

* cited by examiner

*Primary Examiner*—Hal Wachsman
(74) *Attorney, Agent, or Firm*—Pillsbury Winthrop LLP

(57) ABSTRACT

An internal sensor is moved in a direction of stacking of note bundles within a cashbox along bands of the bundles. The bands of bundles are detected in accordance with movement of the internal sensor. The number of bundles within the cashbox is counted on the basis of a difference in level between a sensor output obtained when the band is sensed and a sensor output obtained when a location between the bundles, where the band is absent, is sensed.

25 Claims, 14 Drawing Sheets

NOTE BUNDLE MANAGING APPARATUS TO STORE AND COUNT NOTE BUNDLES

BACKGROUND OF THE INVENTION

The present invention relates to a note bundle managing apparatus such as a note bundle dispenser having functions of bundling notes into note bundles, for example, in units of 100 sheets by using bands, counting the note bundles, and dispensing the note bundles.

The note bundle dispenser is so constructed as to classify and count deposited notes in accordance with the kind of notes, bundle the classified and counted notes in units of 100 sheets, store the note bundles, and dispense the note bundles on an as-needed basis.

In general, in a case where notes are counted, bundled into note bundles and stored in internal cashboxes within the note bundle dispenser, the note bundles are stored in the cashboxes designated in accordance with the kind of notes by means of firmware. Thus, the numbers of note bundles remaining in the cashboxes are always determined in accordance with the kind of notes.

However, in a case where an operator manually has loaded a given number of note bundles of a given kind, which are brought from the outside, into cashboxes or in a case where doors of the note bundle cashboxes are opened, for example, for the purpose of error recovery, and the number of stored note bundles is collated with the mechanical count number, it is possible that the correspondency between the kind of notes and the cashbox is made wrong or the number of note bundles actually stored in the cashbox does not match with the mechanically counted number of note bundles managed by firmware.

In the above cases, the operator is conventionally required to check once again the kind and the number of note bundles in the cashbox in order to ensure the counted value. However, the result of the manual check of the number of note bundles is not perfectly sure, and it is desirable, if possible, not to conduct the manual check in order to avoid the occurrence of an unexpected situation.

The present invention, therefore, aims at providing a note bundle managing apparatus having a function of easily and exactly counting and determining the number of note bundles within a paper sheet storage box such as a cashbox, without requiring manual operations

BRIEF SUMMARY OF THE INVENTION

A note bundle managing apparatus of the present invention comprises a storage box for storing note bundles each formed by bundling a predetermined number of notes, and a bundle counting means provided within the storage box.

A note bundle managing apparatus of the present invention comprises:

- a storage box for storing, in a stacked manner, note bundles each formed by bundling a predetermined number of notes;
- bundle counting means provided within the storage box and moved in a direction of stacking of the note bundles to count the number of the note bundles;
- distance detection means for detecting a distance over which the bundle counting means has moved along the stacked bundles within the storage box;
- calculation means for calculating the number of the stored bundles on the basis of the distance of movement of the bundle counting means within the storage box which has been detected by the distance detection means; and
- means for determining the number of note bundles stored in the storage box on the basis of the bundle counting means and the calculation means.

With the above structures, the number of note bundles stored, for example, in the cashbox can be exactly counted by the internal bundle counting means without manual operations. Thus, there is provided a note bundle managing apparatus capable of managing note bundles with easy and security.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A first embodiment of the present invention will now be described with reference to the accompanying drawings.

Figure 1:
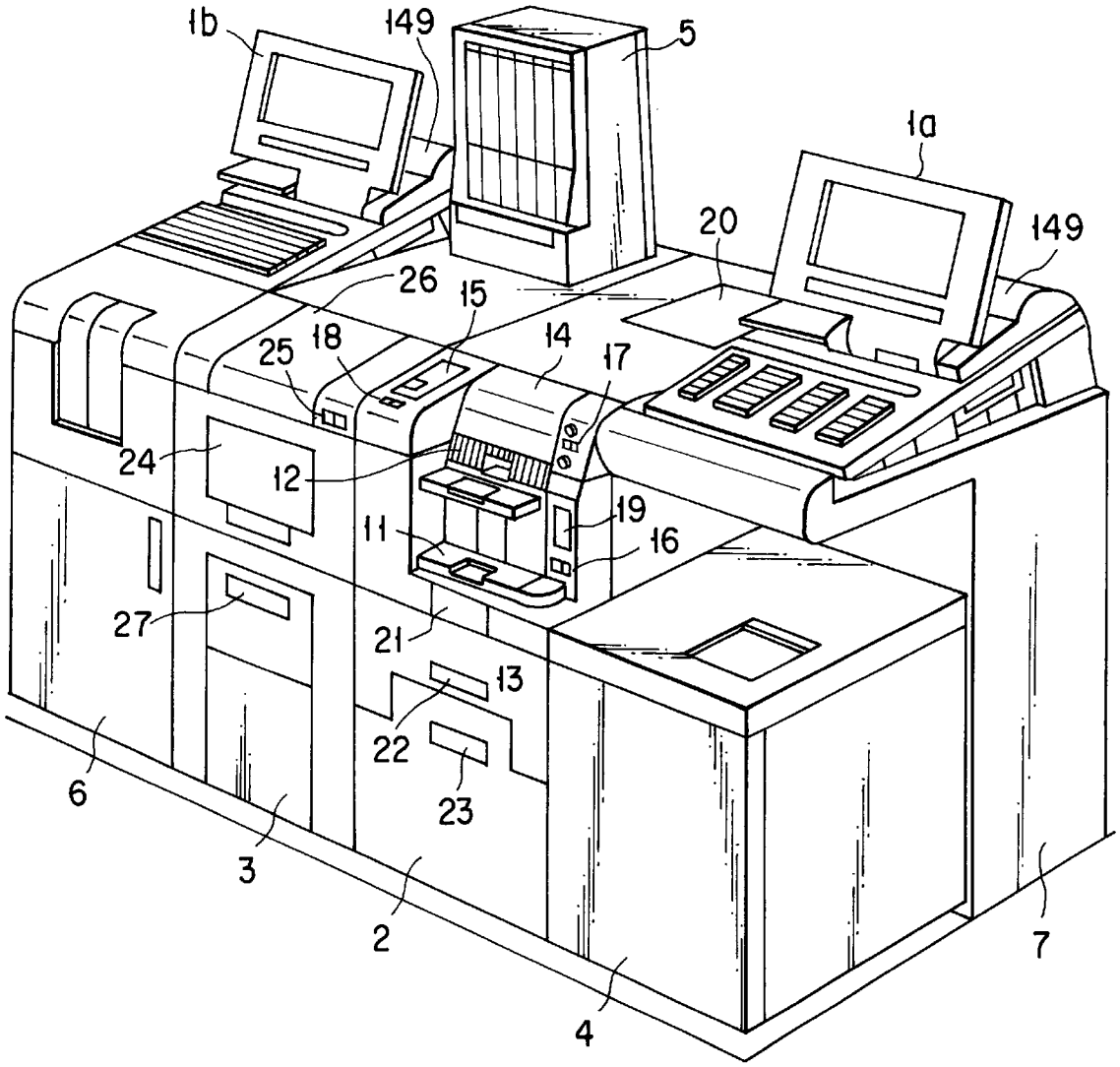
FIG. 1 is a perspective view showing an external appearance of a note parallel management system according to an embodiment of the present invention.

FIG. 1 shows a cash management system for use in a bank branch according to the first embodiment of the invention.

This system includes two teller machines 1*a* and 1*b* for performing the operations and data processing of the entire system. The system also includes a note depositing/dispensing machine 2 serving as a first unit for depositing and dispensing non-bundled notes, and a bundling/note-bundle dispensing machine 3 serving as a second unit for bundling excess notes in the depositing/dispensing machine 2, storing the note bundles within the machine and dispensing the note bundles.

The system also includes a coin deposit machine 4 for depositing non-rolled coins, and a coin dispenser 5 for dispensing non-rolled coins. Moreover, the system includes a coin-roll dispenser 6 for dispensing rolls of coins, each roll comprising 50 coins, for example, and a teller machine table 7.

The note depositing/dispensing machine 2 includes a note inlet 11 and a deposit cash reject box 12 for stacking rejected notes at the time of depositing. The note depositing/dispensing machine 2 also includes a rejected dispensed note box 13 for stacking rejected notes at the time of dispensing, and a note outlet 14 in which notes to be dispensed are stacked.

The note inlet 11, deposit cash reject box 12, rejected dispensed note box 13, and note outlet 14 are disposed vertically in line on the front side of the machine 2. A journal printer 15 for printing the details of cash management is disposed on the top side of the note depositing/dispensing machine 2.

In the vicinity of the note inlet 11, note outlet 14 and journal printer 15, there are provided pairs of occupation lamps 16, 17 and 18 for indicating which of the two teller machines 1*a* and 1*b* occupies the inlet 11, outlet 14 and printer 15.

A residual indicator 19 for indicating the residual amount of notes in the note storage box (described later) in the note depositing/dispensing machine 2 is provided on the front face of the machine 2. An odd-note return door 20 (described later) for returning odd notes to be bundled is provided on the top surface of the note depositing/dispensing machine 2. The return door 20 is popped up above the machine 2 at the time of returning notes.

A deposited money path door 21, a temporary stack door 22 for returning notes at the time of depositing, and a storage box door 23 for drawing the note storage box are disposed, in the named order from above, on the front side of the note depositing/dispensing machine 2.

On the other hand, the bundling/note-bundle dispensing machine 3 has a cash dispense door 24. The door 24 is opened to permit taking-out of the note bundle. A pair of occupation lamps 25, which are similar to the occupation lamps of the note depositing/dispensing machine 2, are disposed near the cash dispense door 24.

A band set door 26 for exchanging bands for bundling is provided above the cash dispense door 24, and the exchange of bands is performed by opening the door 26. A defective cashbox take-out door 27 is disposed below the cash dispense door 24 to permit take-out of a defective cashbox storing defective notes (to be described below).

A detailed description of the coin deposit machine 4, coin dispenser 5 and coin-roll dispenser 6 may be omitted here.

The internal structures of the note depositing/dispensing machine 2 and bundling/note-bundle dispensing machine 3 will now be described in detail.

Figure 2:
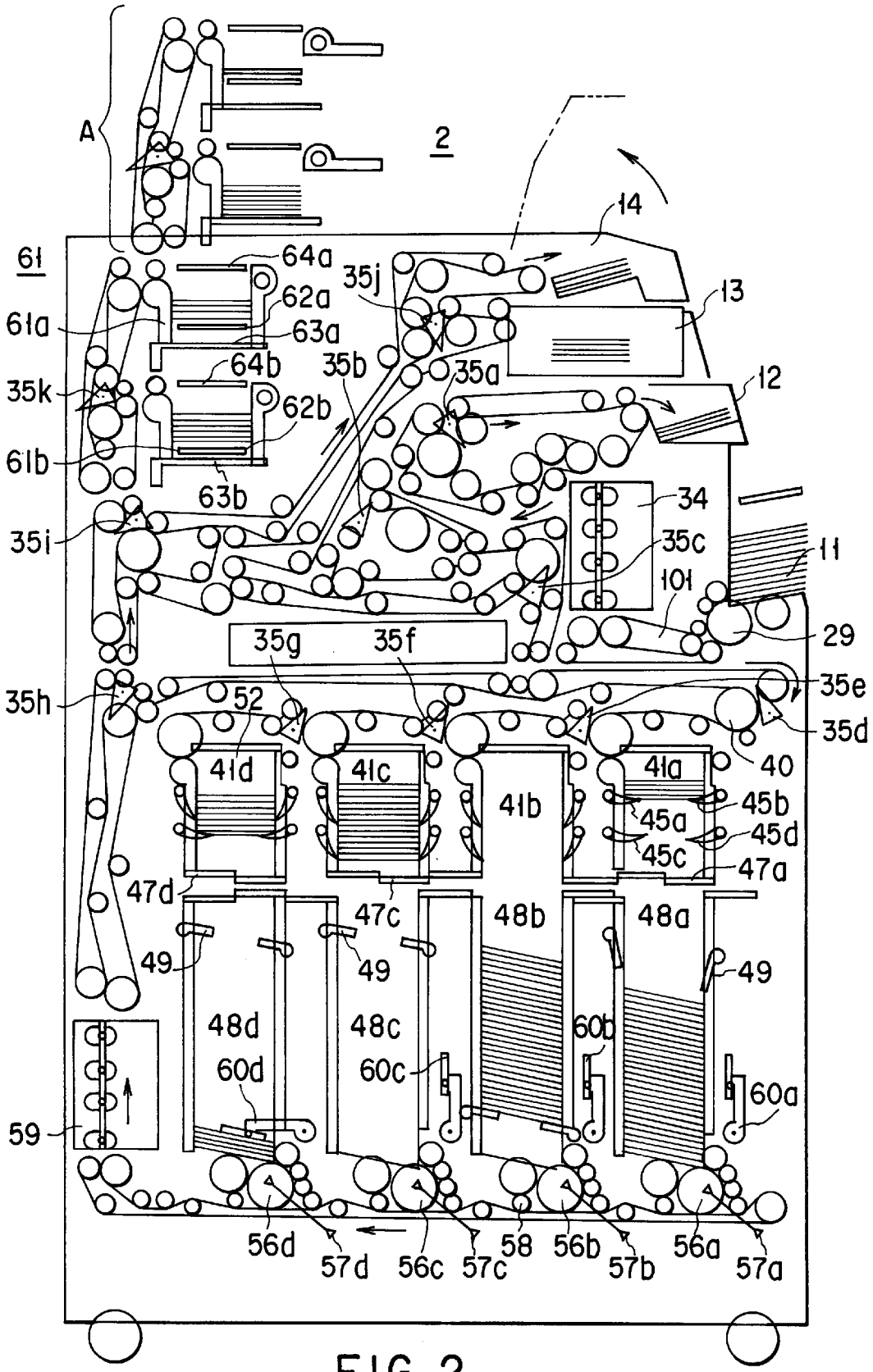
FIG. 2 shows an internal structure of a note depositing/dispensing machine shown in FIG.
Figure 3:
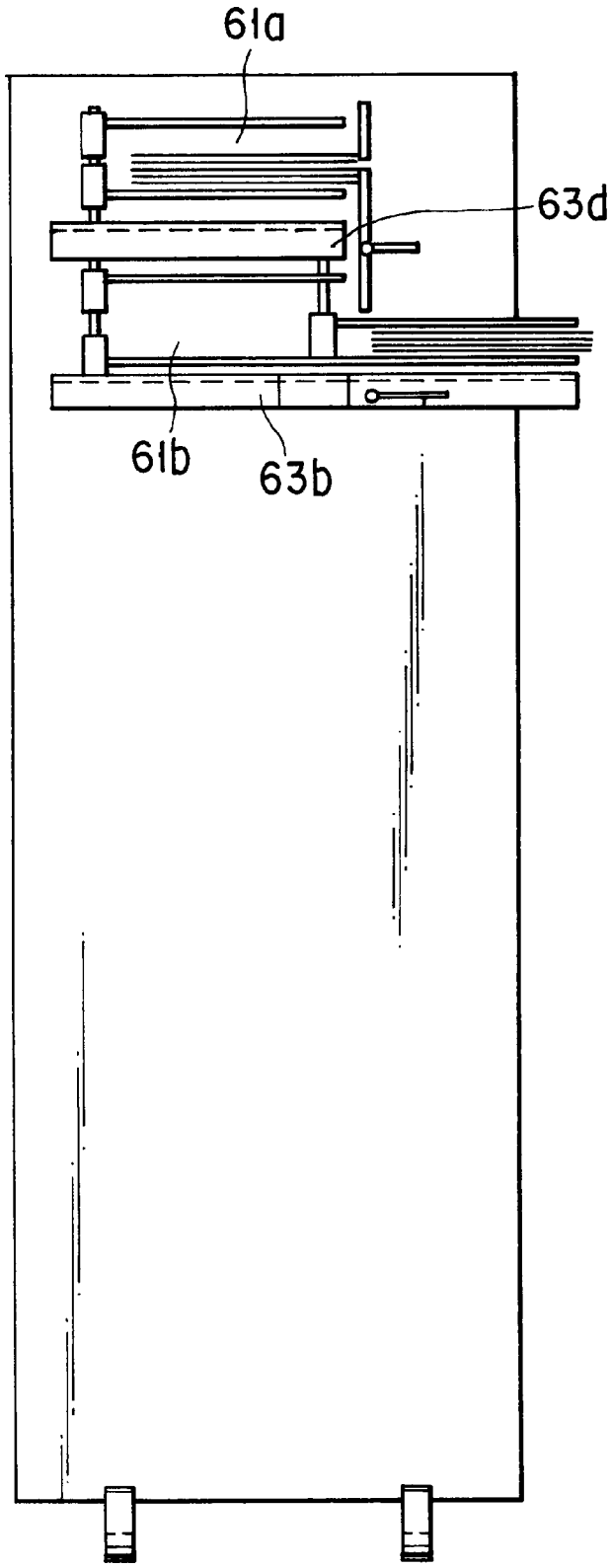
FIG. 3 is a rear-side view of the note depositing/dispensing machine shown in FIG. 2.

FIG. 2 is a side view showing the internal structure of the note depositing/dispensing machine 2, and FIG. 3 is a rear view showing the internal structure of the same. When notes are to be deposited in the note depositing/dispensing machine 2, the notes are placed at the note inlet 11 and a deposit start command is issued through the teller machine 1*a* or 1*b*. Thereby, the notes are taken into the inlet 11 one by one.

The note taken in the inlet 11 travels along a pre-check transfer path 101 serving as first transfer means and is guided to a check section (check means) 34. The kind, shape, obverse/reverse, authenticity, defectiveness/non-defectiveness, etc. of the taken-in note is checked in the check section 34.

On the basis of the check results, the notes are sorted into stackers by using sort gates 35*a* to 35*k* serving as sort means in which a control section comprising a CPU, etc. (to be described below) is disposed along the transfer path.

Uncheckable notes, which come out of the check section 34, are sorted by the first deposit cash reject gate 35*a* and stacked in the deposit cash reject box 12. The uncheckable note is reset at the note inlet 11 and taken in once again, or the number of the notes are counted manually and the obtained value is input by an operator.

The checked notes are sent to an obverse/reverse regulating mechanism by the obverse/reverse gate 35*b*, and all notes are regulated so that the obverse sides of all notes are directed upward.

The notes, the obverse/reverse sides of which have been regulated, are selectively sent to the lower storage section or to the cash dispense path by the arrange gate 35*c*. A description will be given of the case where the notes are sent to the cash dispense path. In general deposit operations, the notes are sent to the lower storage section. The notes sent downward are passed through the cashbox gate 35*d* and guided to a sort path 40. A detailed description of the processing of notes coming out of the cashbox gate 35*d* is omitted here. The notes coming in the sort path 40 are guided to temporary stack boxes 41*a* to 41*d* by the temporary stack gates 35*e* to 35*g* in accordance with the kind and defectiveness/non-defectiveness of notes.

The notes guided into the temporary stack boxes 41*a* to 41*d* are stacked on flappers 45*a* and 45*d* in the boxes 41*a* to 41*d*, while being aligned by an aligning mechanism (not shown). When the stacking operation is started, all flappers 45*a* to 45*d* are positioned so as to receive the incoming notes.

The flappers 45*a* to 45*d* are linked to flapper drive solenoids (not shown) respectively. By activating the drive solenoids, the flappers 45*a* to 45*d* are rotated about 90° downward.

As the number of notes stacked on the flappers 45*a* and 45*b* increases, the thickness of the stacked notes gradually increases and the position of the uppermost note in the stacked notes moves upward. At a predetermined position, the surface of the uppermost note is sensed by a full-stack sensor (not shown).

If the full-stack state of notes is sensed by the full-stack sensor, the flappers 45*a* and 45*b* are rotated about 90° downward and the stacked notes are dropped. The dropped notes are then supported on the lower flappers 45*c* and 45*d*.

If the stacking of notes is continued, the surface of the uppermost of the stacked notes is sensed once again by the full-stack sensor. At this time point, the control section first tells the full-stack state in the stack section to the teller machine 1*a* or 1*b*.

Since the temporary stack boxes are thus constituted, the notes can always be stacked at a proper depth or height of stacking. Accordingly, a fault, which tends to occur in the stack section, for example, turn-up of notes due to excessive stacking height or free fall distance in the stack section, can be prevented. Furthermore, smooth stacking with a greater capacity can be achieved.

The stacked notes are stored on shutters 47 at a proper position for taking out. If the shutters 47 are opened to both sides by a drive mechanism (not shown), the stacked notes fall in storage boxes 48*a* to 48*d*. In the storage boxes 48*a* to 48*d*, separators 49 are standing by at positions near the upper ends of the storage boxes.

Thus, the notes are let to fall on the separators 49.

If the shutters 47 are opened, a pusher mechanism 52 standing by above the temporary stack section, 41*a*–41*d*, is driven to shift all the notes remaining in the temporary stack section, 41*a*–41*d*, into the storage box, 48*a*–48*d*.

If the shift is completed, the pusher 52 rises and the shutters 47 are closed. In this state, the next deposit of notes is awaited.

The separators 49 are selectively rotated downward or upward in accordance with the height of the stored notes. The height of the stored notes is sensed by a sensor (not shown) and the best method is selected by the control section.

Where the number of notes is large in the storage box, 48*a*–48*d*, the separators 49 should be rotated downward from above onto the notes, when rotated once again onto the notes, in consideration of effective use of space. The note deposit process is completed through the series of the above operations.

A note dispense process will now be described.

The note dispense process is effected by sending the notes stacked in the storage boxes 48*a*–48*d* to the note outlet 14. If a note dispense start command is sent from, for example, the teller machine 1*a* to the note depositing/dispensing machine 2, the control section in the note depositing/dispensing machine 2 drives a take-out mechanism, 56*a*–56*d*, of the storage box, 48*a*–48*d*, in which the notes of the kind to be dispensed are stacked. The take-out mechanism, 56*a*–56*d*, is the same as the take-in mechanism disposed at the note inlet 11.

The notes are taken out one by one by rotating the take-out mechanism or roller, 56*a*–56*d*. The number of taken-out notes is counted by a taken-out note counter sensor, 57*a*–57*d*, provided immediately after the take-out port. If the count value reaches the number of notes to be dispensed, the take-out mechanism, 56*a*–56*d*, is stopped and the take-out operation is completed.

The taken-out notes are transferred to a dispensed note check section 59 along a sub-storage-box transfer path 58. The dispensed note check section 59 checks the presence of non-separated or overlapped notes and the kind of note. If there is no problem with the notes, the notes are sent to an upper-stage note transfer path. If there is a problem with the notes, the take-out mechanism is instructed to take out additional notes. The notes coming out of the dispensed note check section 59 are passed through an examination gate 35*h* to the upper-stage note transfer path. The notes are then sent to the note outlet by a bundling gate 35*i*.

The notes which are sent to the other side through the gates 35*h* and 35*i* will be described later.

Of the notes transferred toward the note outlet 14 by the bundling gate 35*i*, those determined to have problems by the dispensed note checking are sent to the rejected dispensed note box 13 by a dispensed note reject gate 35*j* and those to be properly dispensed are stacked at the note outlet 14.

If the designated number and kind of notes have been stacked at the note outlet 14, an electromagnetic lock (not shown) is released and the note outlet is opened, in the direction shown by an arrow, to a position as indicated by a two-dot-and-dash line. Thus, the take-out of the notes is permitted and the note dispense process is completed.

The notes in the storage box, 48*a*–48*d*, are normally pressed on the feed roller of the take-out mechanism, 56*a*–56*d*, by their own weight and thus can be stably taken out. If the number of remaining notes decreases, however, a back-up mechanism, 60*a*–60*d*, is rotated into the storage box 48*a*–48*d*, to press the notes downward in the storage box 48*a*–48*d*. Thus, smooth take-out of notes is performed. The number of remaining notes is determined by detecting the position of the surface of the uppermost of the notes in the storage box 48*a*–48*d*, by means of a sensor (not shown).

A bank note examination operation in the cashbox will now be described. In the examination operation in the cashbox, the number of notes in the storage box 48*a*–48*d* is counted. Specifically, the number of notes in the storage box 48*a*–48*d*, which cannot be determined after the dispensing of notes is completed, is confirmed.

If a request for note examination has been input from the teller machine 1*a* or 1*b*, the take-out of notes is started from one of the storage boxes 48*a*–48*d*. The kind of the taken-out notes is determined by the dispensed note check section 59 and the determined notes are stacked in one of the temporary stack boxes 41*a*–41*d* situated above the storage boxes 48*a*–48*d*.

On the other hand, the non-determined notes are stacked in the rejected dispensed note box 13. However, if the storage box, from which the notes are taken out, is the box 48*a*, at least one of the temporary stack box 41*b*–41*d* provided above the other storage box 48*b*–48*d* may be used as the reject box.

If the temporary stack box 41*a*–41*d* is filled with the stacked notes, the notes are stored in the storage 48*a*–48*d* in the same manner as in the note deposit process. In this case, the separators 49 are not driven from its separating position after storage of notes and the examined notes are separated from the notes before examination.

In this state, the take-out of notes is continued until there remains no note before examination. If all notes have been taken out, the number and kind of all notes in the storage box 48*a*–48*d* are determined. At this time, if the number of remaining notes in the storage box 48*a*–48*d* is large, the shutters 47 cannot be closed, but the notes can be examined with the shutters 47 opened. Since the separators 49 are mounted at a position lower than that the shutters 47, if the notes are examined with the shutters 47 opened, the temporary stack box 41*a*–41*d* can have a large capacity by virtue of the operation of the separators 49. Therefore, an advantage is obtained in that the notes can be examined without suspending the operation of taking out the notes from the storage box 48*a*–48*d*.

A description will now be given of an operation of automatically sending notes to the bundling machine 3 when the number of notes in the storage box 48*a*–48*d* has exceeded a predetermined value, 100, for example.

A process of bundling notes in the storage box 48*a*–48*d* is referred to as "storage box automatic arrangement." If the number of notes in the storage box 48*a*–48*d* exceeds a predetermined value, the storage box automatic arrangement is started. This predetermined value may be set by the teller machine 1*a* or 1*b*. By setting the predetermined value, the number of notes in the storage box 48*a*–48*d* is kept less than the predetermined value at all times, respectively.

If the number of notes in the storage box 48*a*–48*d* exceeds the predetermined value, a storage box arrangement program is automatically activated and the take-out of notes from the storage box 48*a*–48*d* is started. The kind, etc. of the taken-out notes are determined by the dispensed note check section 59 and only the notes proper to bundling are sent to a bundling/stacking section 61 by the bundling gate 35*i*. If 100 notes have been sent to the bundling/stacking section 61, the notes are delivered to a bundling section by a mechanism/process (to be described below).

On the other hand, the control section in the note depositing/dispensing machine 2 checks the number of remaining notes in the storage box 48*a*–48*d* on the basis of record data stored each time 100 notes have been taken out. If the number of remaining notes is less than the predetermined value, the take-out of notes is stopped. Thereby, the number of notes in the storage box 48*a*–48*d* is kept within a range less than the predetermined value at all times.

A description will now be given of the bundling/stacking section 61 serving as stacking means. As is shown in FIG. 2, the bundling/stacking section 61 comprises stacking sections 61*a* and 61*b* vertically arranged, as shown in FIG. 2. The two stack sections 61*a* and 61*b* are switched by a stack switch gate 35*k*.

The notes taken out of the storage box 48*a*–48*d* are first stacked in the upper bundling/stacking section 61*a*. The stacked notes are placed on a bundling/stacking back-up 62*a* and a certain distance from a stack outlet is maintained. If the stacking continues and the uppermost one of the stacked notes approaches the stack outlet, the full state is sensed by a full-stack sensor (not shown).

If the full-stack state is sensed, the bundling/stacking back-up 62*a* is lowered to a lower limit by an associated drive mechanism and the notes are shifted onto a bundling horizontal carrier 63*a*. If the stacking further continues and 100 notes have been stacked in the upper-stage bundling/stacking section 61*a*, the subsequently delivered notes are stacked in the lower-stage bundling/stacking section 61*b* by means of the stack switch gate 35*k*.

On the other hand, the 100 notes stacked in the upper-stage bundling/stacking section 61*a* are shifted to the bundling machine 3 by the bundling horizontal carrier 63*a* serving as second transfer while the 100 notes are being pressed downward by a bundling/stacking clamp 64*a*. At this time, the bundling/stacking clamp 64*a*, which is fixed on the bundling horizontal carrier 63*a*, moves along with the carrier 63*a*.

The shifted 100 notes are pulled out from the bundling horizontal carrier 63*a* by a mechanism (described later) of the bundling machine 3. If the pull-out of notes is detected, the bundling horizontal carrier 63*a* is restored to the original position. At this time, the bundling/stacking back-up 62*a* and bundling/stacking clamp 64*a* are also restored to the original position.

The above operations constitute one cycle and subsequently the lower-stage bundling/stacking section 61*b* sends 100 notes to the bundling machine 3 through similar operations. Since the upper and lower bundling/stacking sections 61*a* and 61*b* alternately deliver the notes in units of 100 to the bundling machine 3, the bundling operation can be successively performed.

If odd notes remain at the time of bundling, the bundling/stacking sections 61*a* and 61*b* are popped up along with the transfer path of the preceding stage, as indicated by A in FIG. 2. Thus, the notes remaining in the stacking sections 61*a* and 61*b* can be taken out.

Figure 4:
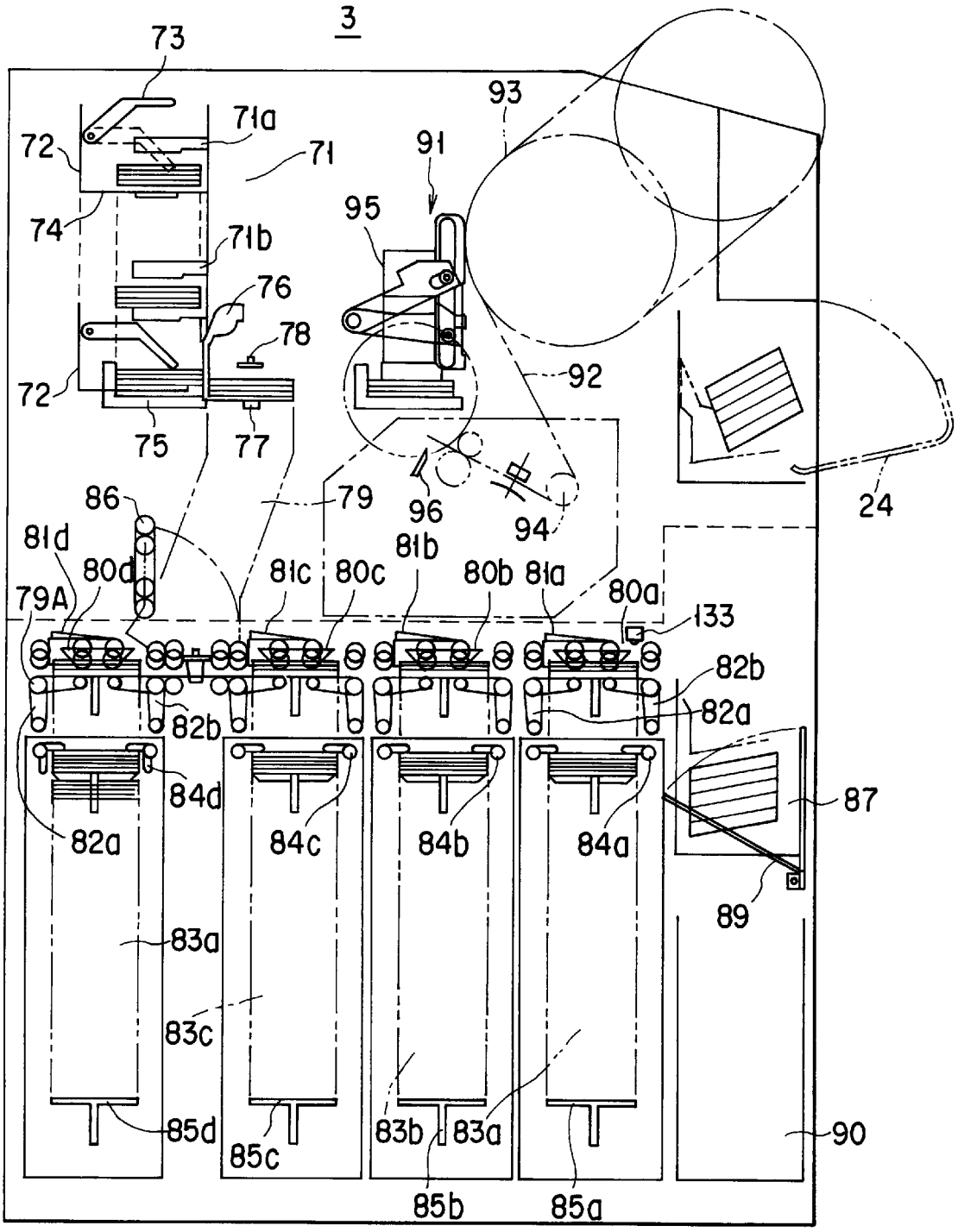
FIG. 4 shows an internal structure of a bundling/note-bundle dispensing machine in the system shown in FIG. 1.

The bundling/note-bundle dispensing machine 3 will now be described, by referring to FIG. 4. FIG. 4 is a side view of this machine 3.

The notes are delivered to the bundling/note-bundle dispensing machine 3 from the bundling/stacking sections 61*a* and 61*b* of note depositing/dispensing machine 2. If the bundling/stacking sections 61*a* and 61*b* are introduced into the bundling/note-bundle dispensing machine 3 from the note depositing/dispensing machine 2, a bundle hand unit 71 moves to receive the notes. The bundle hand unit 71 comprises an upper bundle hand section 71*a* and a lower bundle hand section 71*b*. Whether the notes are delivered from the upper bundling/stacking section 61*a* or lower bundling/stacking section 61*b*, the notes can be held.

The bundle hand sections 71*a* and 71*b* are constructed on a common base, and these are shifted as one body.

Three positions of the bundle hand sections 71*a* and 71*b*, i.e. a note clamp position, a note release position and a stand-by position, can be sensed by a hand position sensor (not shown).

The operation of receiving notes from the note depositing/dispensing machine 2 is as follows. If a designated number of notes have been stacked in the bundling/stacking section 61, the note depositing/dispensing machine 2 issues signals indicating the deliverable state of notes and the designation of the upper/lower bundling/stacking section 61*a*, 61*b* to the bundling/note-bundle dispensing machine 3. The bundling/note-bundle dispensing machine 3, which has received the signals, sets a back-up mechanism (to be described later) to the upper stage or lower stage in accordance with the signals from the depositing/dispensing machine 2.

The bundle hand section 71*a* or 71*b*, which has positioned in the stand-by position, begins to move to the note clamp position and clamps the notes by means of a note clamp mechanism (not shown). The bundle hand section 71*a* or 71*b*, which has clamped the notes, moves to the note release position while dragging the notes and waits until the back-up mechanism 72 clamps the notes. If the back-up mechanism 72 has clamped the notes, the bundle hand section 71*a* or 71*b* releases the notes and returns to the stand-by position. Thus the one-cycle operation of the bundle hand section is completed and the dragging of the notes is finished.

The back-up mechanism 72 will now be described. The back-up mechanism 72 includes a note receive table 74 and a back-up clamp mechanism 73 situated above the table 74. The back-up mechanism 72 can sense, by means of sensors (not shown), three positions: an upper-stage note receive position, a lower-stage note receive position and a carrier transfer position.

The back-up mechanism 72, which has received the notes from the bundle hand unit 71, waits until the bundle hand unit 71 returns to the stand-by position and then begins to move from the upper-stage note receive position or lower-stage note receive position. At this time, the back-up clamp mechanism 73 is in the clamping state and prevents the notes from falling from the back-up mechanism 72.

When the back-up mechanism 72 has moved to the carrier transfer position, the position of the notes is set to be on level with a carrier 75 serving as third transfer means. If the carrier 75 moves forward in this state, the notes are pushed by the back plate of the carrier 75 and drawn out of the back-up mechanism 72. The transfer of the notes from the back-up mechanism 72 to the carrier 75 is completed through the above operations.

When the carrier 75 begins to move forward, the notes are clamped by a carrier clamp (not shown) so that the notes may not fall from the carrier 75. A bundling shutter 76 situated in front of the carrier 75 is constructed so as to pass the notes while being pushed and rotated by the notes on the carrier 75 in the direction of movement of the carrier 75.

The carrier 75 can sense, by means of sensors (not shown), three positions: a note receive position, a bundle position and a vertical carrier transfer position.

The notes on the carrier 75 is moved to a bundling mechanism 91 by the carrier 75 to be bundled. The bundling mechanism 91 comprises a supply section 93 of a band 92, a feed roller 94 for feeding the band 92 supplied from the supply section 93, a winding mechanism 95 for winding the band 92 around the notes, and a cutter 96 for cutting the band 92 after wound around the notes.

The bundled notes is shifted by the carrier 75 from the bundling position to the vertical carrier transfer position, and there the carrier 75 stops. In this case, the note bundle abuts on the outer side surface of the bundling shutter 76 and stops at a predetermined position. At this time, a vertical carrier 77 rises from the wait position below the carrier 75 and moves to a position where the note bundle on the carrier 75 can be held by a vertical carrier clamp mechanism 78.

The vertical carrier 77, which has been shifted, holds the note bundle on the carrier 75 by means of the vertical carrier clamp mechanism 78 associated with the vertical carrier 77. If the vertical carrier clamp mechanism 78 has clamped the note bundle, the carrier 75 begins to move further and returns to the note receive position. At this time, the note bundle is pushed by the bundling shutter 76 and displaced from the carrier 75.

The note bundle of 100 notes completely placed on the vertical carrier 77 lowers along with the vertical carrier 77 and enters a bundle transfer path 79.

Figure 5:
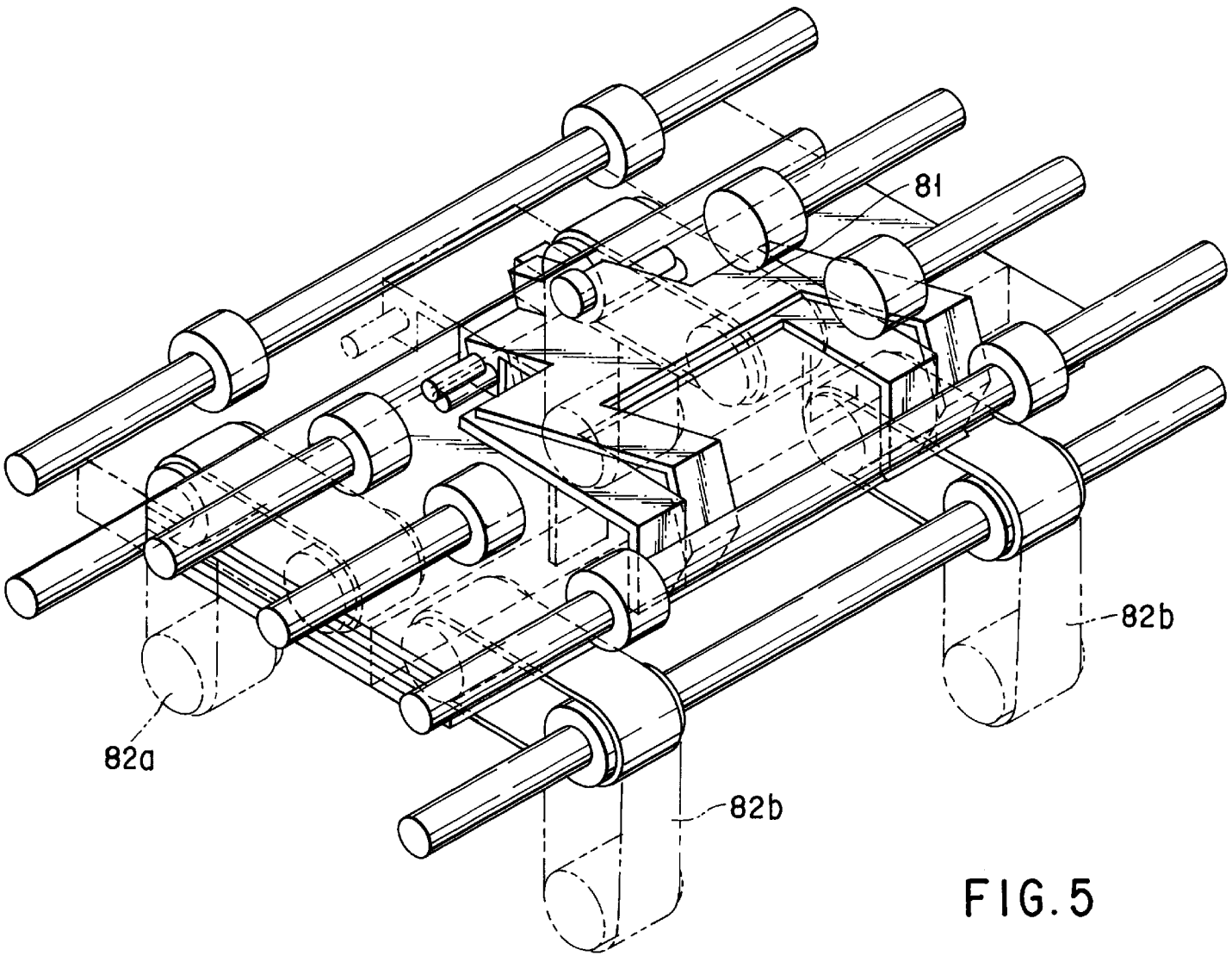
FIG. 5 is a perspective view showing a picker section of the bundling/note-bundle dispensing machine shown in FIG. 4.

A bundle transfer mechanism includes bundle pusher mechanisms 80*a*–80*d* on the upper surface of the transfer path, and picker mechanisms 81*a*–81*d* shown in FIG. 5. A transfer shutter mechanism 82*a*, 82*b* for guiding bundles on the transfer path into note bundle boxes 83*a*–83*d* are provided under each pair of bundle pusher mechanism 80*a*–80*d* and picker mechanism 81*a*–81*d*. The four note bundle boxes 83*a*–83*d* are disposed under the transfer path, and note bundles are stored in the bundle boxes 83*a*–83*d* in accordance with the kind of note bundles.

The bundles in the bundle boxes 83*a* to 83*d* can be returned to the transfer path by means of stopper mechanisms 84*a*–84*d* and bundle box back-up mechanisms 85*a*–85*d* disposed in the bundle boxes 83*a*–83*d*.

A detailed description will now be given of a process of storing the bundles, moved by the vertical carrier 77, into the bundle boxes 83*a*–83*d* along the transfer path.

If the vertical carrier 77 approaches the transfer path while clamping the bundle, a transfer path opening/closing mechanism 86 is opened by a drive motor (not shown).

The vertical carrier 77, which has entered the transfer path, moves to a fixed position in the transfer path and waits until the transfer path opening/closing mechanism 86 is closed. If the transfer path opening/closing mechanism 86 is closed, the bundle is transferred through the transfer path by a drive roller (not shown) disposed telescopically in the vertical carrier 77.

The bundle is stopped above the bundle box, e.g. bundle box 83*d*, in which it is to be stored, and it stays in this position for storage. At this time, the stop position of the bundle is adjusted by the picker mechanism 81 shown in FIG. 5.

If the bundle stays immediately above the bundle box 83*d*, the right and left transfer shutters 82*a* and 82*b* are rotated downward by a drive mechanism (not shown) and the bundle falls into the bundle box 83*d*. At the same time, the bundle pusher mechanism 80*d* is driven downward in accordance with the driving of the transfer shutters 82*a* and 82*b* to push the bundle so that the bundle may not be caught en route.

The bundle, which has fallen, rests on the pair of stopper mechanisms 84*d*, and then it is pushed into the bundle box 83*d* by the bundle pusher mechanism 80*d*. The stopper mechanisms 84*a*, along with the bundle, are rotated inside the bundle box 83*d*. The stopper mechanisms 84*d* are urged by springs, etc. such that the stopper mechanisms 84*d* are automatically returned to the original positions when the end of the bundle has reached a position where it is separated from the stopper mechanisms 84*d*.

FIG. 4 shows both the closed and open states of the stopper mechanisms 84*d* with reference to the note bundle box 83*d*. The other stopper mechanisms 84*a*–84*c* are all closed. If the bundle pusher mechanism 80*d* has completed the pushing action to the position where the stopper mechanisms 84*d* are returned, the bundle pusher mechanism 80*d* returns to the fixed position and the transfer shutters 82*a* and 82*b* are closed, and thus the storage of the bundle in the box 84*d* is completed.

The other bundle boxes 83*a*–83*c* have the same structure and function.

The bundle stored in the box 84*d* is constantly urged upward by the bundle box back-up mechanism in the box 83*d*. The bundle is set in a state in which it is held by the closed stopper mechanisms 84*d*.

When the bundle is to be deposited, the transfer shutters 82*a* and 82*b* of the bundle box, e.g. box 83*d*, from which the bundle is to be deposited, are opened and the bundle pusher mechanism 80*d* is pushed into the box 83*d*. At this time, the bundle in the box 83*d* is pushed downward by the bundle pusher mechanism 80*d* and the stopper mechanisms 84*d* are made rotatable.

The rotatable stopper mechanisms 84*d* are rotated into the box 84*d* by the drive mechanism (not shown) and fixed. Subsequently, if the bundle pusher mechanism 80*d* is raised, the bundles in the box 84*d* are raised by the bundle box back-up mechanism 85*d* up to the upper end of the bundle pusher mechanism 80*d*.

The picker mechanism 81 shown in FIG. 5 is driven to pick only the uppermost of the bundles and introduce it into the bundle transfer path 79A. The introduced bundle is driven by the drive roller on the transfer path 79A and moved along the path 79A. If the bundles are successively dispensed, the picker mechanism 81 is driven repeatedly. If the dispensing of bundles is finished, the bundle pusher mechanism 80*d* is pushed down, as in the case of the deposition, and the remaining bundles are stored in the box 84*d* once again. Thus, the bundle dispensing operation is completed.

The bundles transferred to the bundle transfer path 79A are moved on the transfer path 79A and the kind of notes of the bundles is determined by a note kind sensor 133. The bundles are then let to fall in the elevator 87 from the exit of the transfer path 79A. If all the bundles to be dispensed have been put in the elevator 87, the elevator 87 begins to rise and moves to the cash dispensing position. If the elevator 87 stops at the cash dispensing position, the cash dispense door 24 is opened to a position shown by two-dashed lines in FIG. 4 so that the bundles can be taken out.

If the bundles have been taken out of the elevator 87, the absence of bundles is sensed by a sensor (not shown), the cash dispense door 24 is closed and the bundle dispensing operation is finished.

If the bundles are to be successively discharged to the outside of the machine 3 for the purpose of rearrangement of notes, etc., a bundle shoot gate 89 is opened and the elevator 87 is moved above the bundle transfer path 79A. Thereby, the bundles falling from the bundle transfer path 79A can be directly discharged, as will be described below. This technique is advantageous in that a desired number of bundles can be successively dispensed, despite the capacity of the elevator 87 being definite.

Specifically, a defective note box 90 is disposed below the elevator 87. Normally, note bundles improper to dispensing, e.g. bundles of defective notes or bundles with improper shapes, can be stored in the box 90. In the case of successively discharging bundles for the purpose of rearrangement, etc., the elevator 87 may be raised so that all the note bundles may be fallen from the bundle transfer path 79A and directly stored in the defective note box 90.

The bundle examination operation will now be described. The examination in this operation refers to a confirmation operation as to whether a manually input amount, i.e. the number of bundles, is equal to a count result. The examination of note bundles is an operation of counting the number of bundles in the bundle boxes 83*a*–83*d*. For example, after the operator manually input note bundles or an error occurred, the number of bundles in the bundle boxes 83*a*–83*d*, which became uncertain, is counted and confirmed.

Apart from the counting of bundles, the kind of notes of the bundles is determined at the time of dispensing by a note kind sensor 133 shown in FIG. 4, as will be described later.

Figure 6:
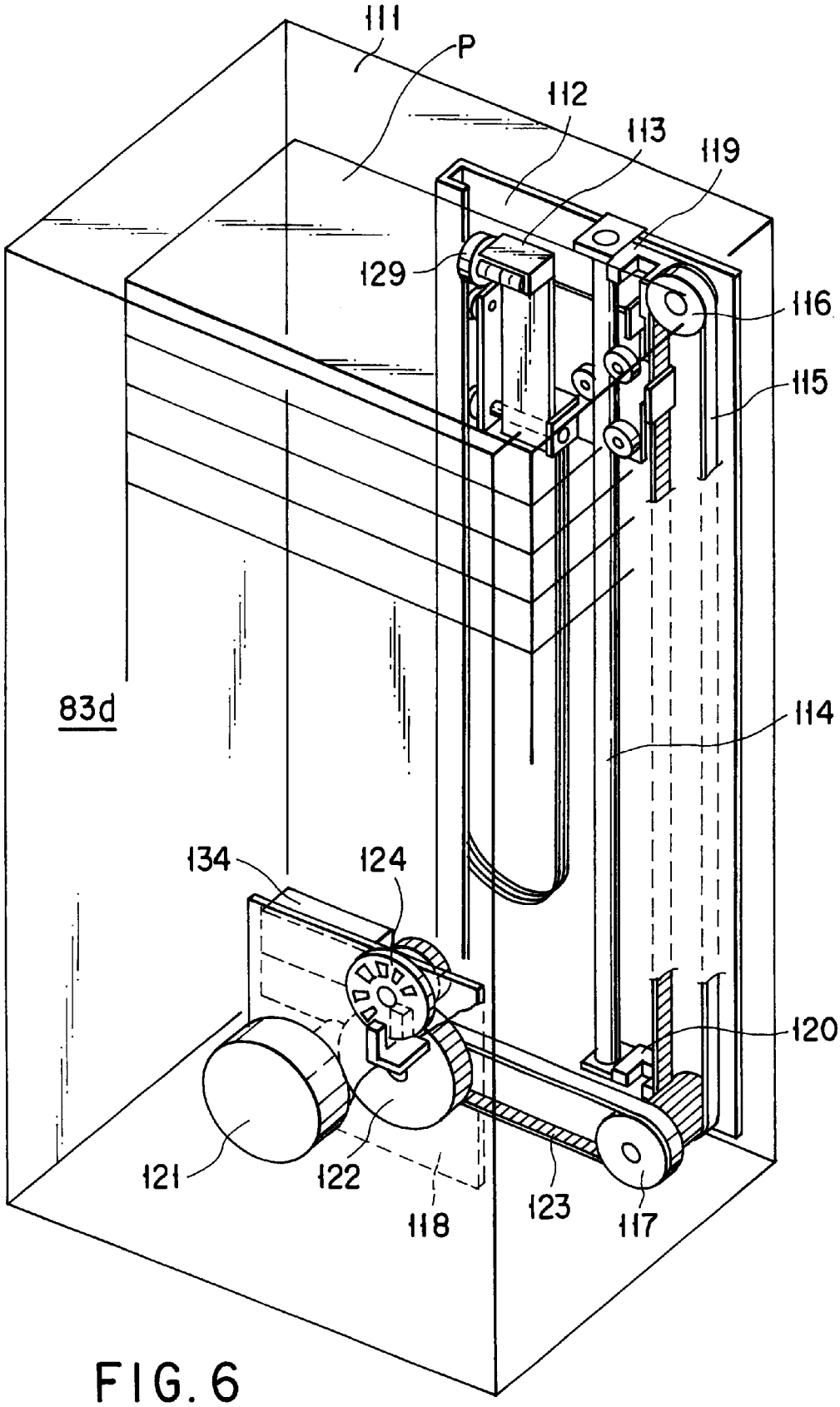
FIG. 6 is a perspective view showing an internal structure of one note bundle cashbox of the bundling/note-bundle dispensing machine shown in FIG. 4.

A bundle examination mechanism will now be described with reference to FIGS. 6 and 7, by referring to the bundle box 84*d* by way of example. FIG. 6 is a perspective view of the bundle box 84*d* and FIG. 7 is a top view of the same.

The bundle box 84*d* has a box-shaped main body 111. A bundle count unit 112 is attached to the inner front side of the main body 111.

Figure 7:
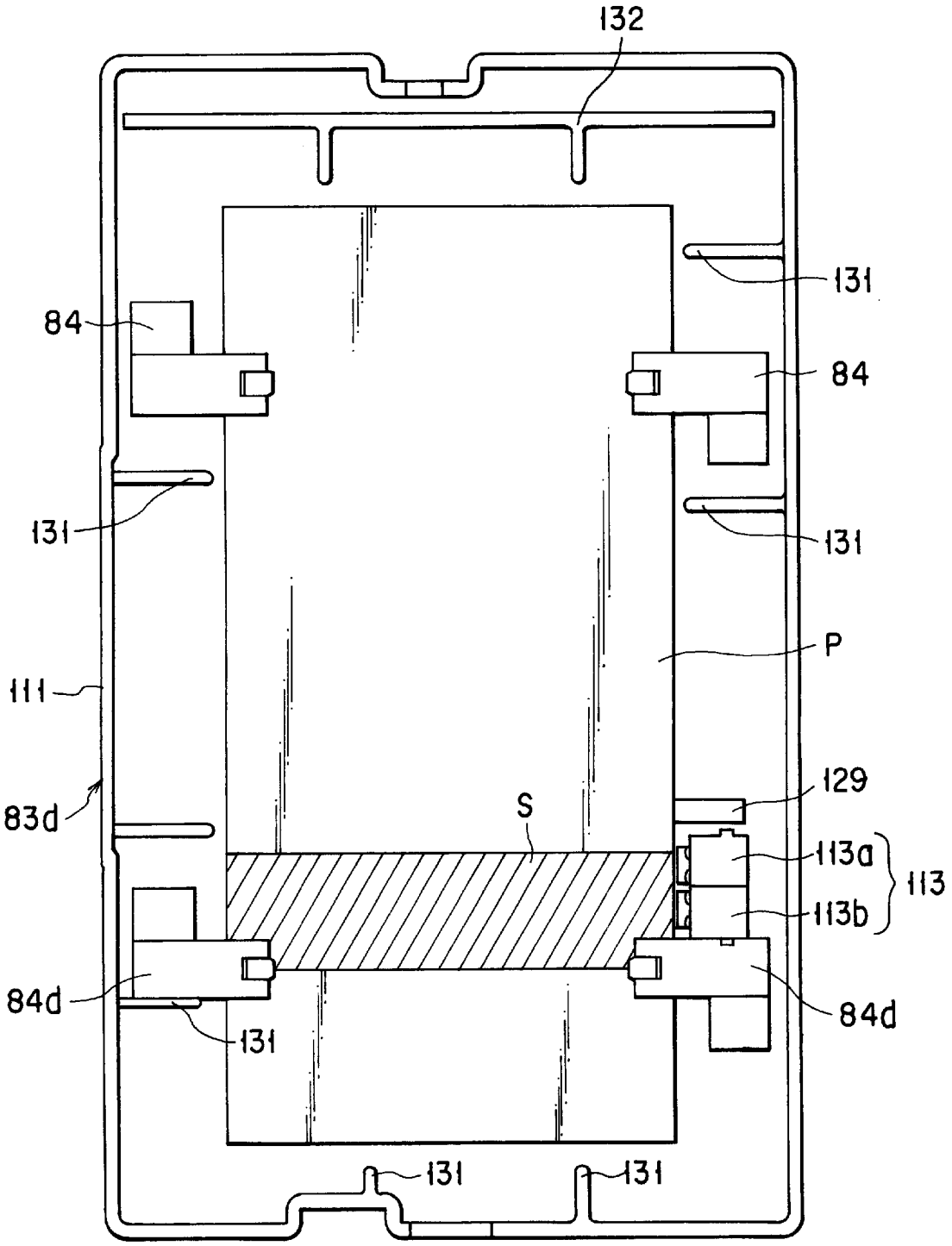
FIG. 7 is a plan view of one note bundle cashbox of the bundling/note-bundle dispensing machine shown in FIG. 4.

The bundle count unit 112, as shown in FIG. 7, has a double count sensor 113 comprising two horizontally disposed sensors 113*a* and 113*b*; a rail 114 for vertically moving the count sensor 113; a timing belt 115; and timing pulleys 116 and 117. The count sensor 113 is directly connected to the timing belt 115. The count sensor 113 is driven by a drive unit 118 (described later) and vertically moved along the rail 114.

An upper-end sensor 119 and a lower-end sensor 120 are provided at upper and lower ends of the rail 114 to sense the upper-end and lower-end positions of the count sensor 113.

The drive unit 118 comprises a motor 121 and a deceleration gear 122. The deceleration gear 122 is coupled to the timing pulley 117 by means of the timing belt 123, thereby to drive the timing belt 115.

The deceleration gear 122 of drive unit 118 is meshed with a gear of an encoder 124. If the encoder 124 is rotated, light reaching a photoelectric conversion element through slits formed in the encoder 124 is interrupted. By counting the number of times of interruption, the rotation of the motor 121 can be detected, that is, the distance of movement of the count sensor 113 can be measured. The encoder 124 may be of the above-mentioned photoelectric type or of an electromagnetic type in which a magnet and a coil are combined.

The upper ends of the sensor elements 113*a* and 113*b* of the count sensor 113 are positioned, as shown in FIG. 7, in the vicinity of the lower end of the stopper mechanism 84*d*. Thus, a band S of the uppermost one of bundles P stacked in the bundle box 84*d* can be sensed.

The lower end of the count sensor 113 is positioned slightly below the lowermost position of the back-up mechanism 85*d* of the bundle box 83*d*. An end mark (not shown) is put on the count sensor (113)-side end face of the back-up mechanism 85*d*. The count sensor 113 reads the end mark, whereby the position of the back-up mechanism 85*d*, i.e. the position of the lowermost one of the stacked bundles, can be determined.

Figure 9:
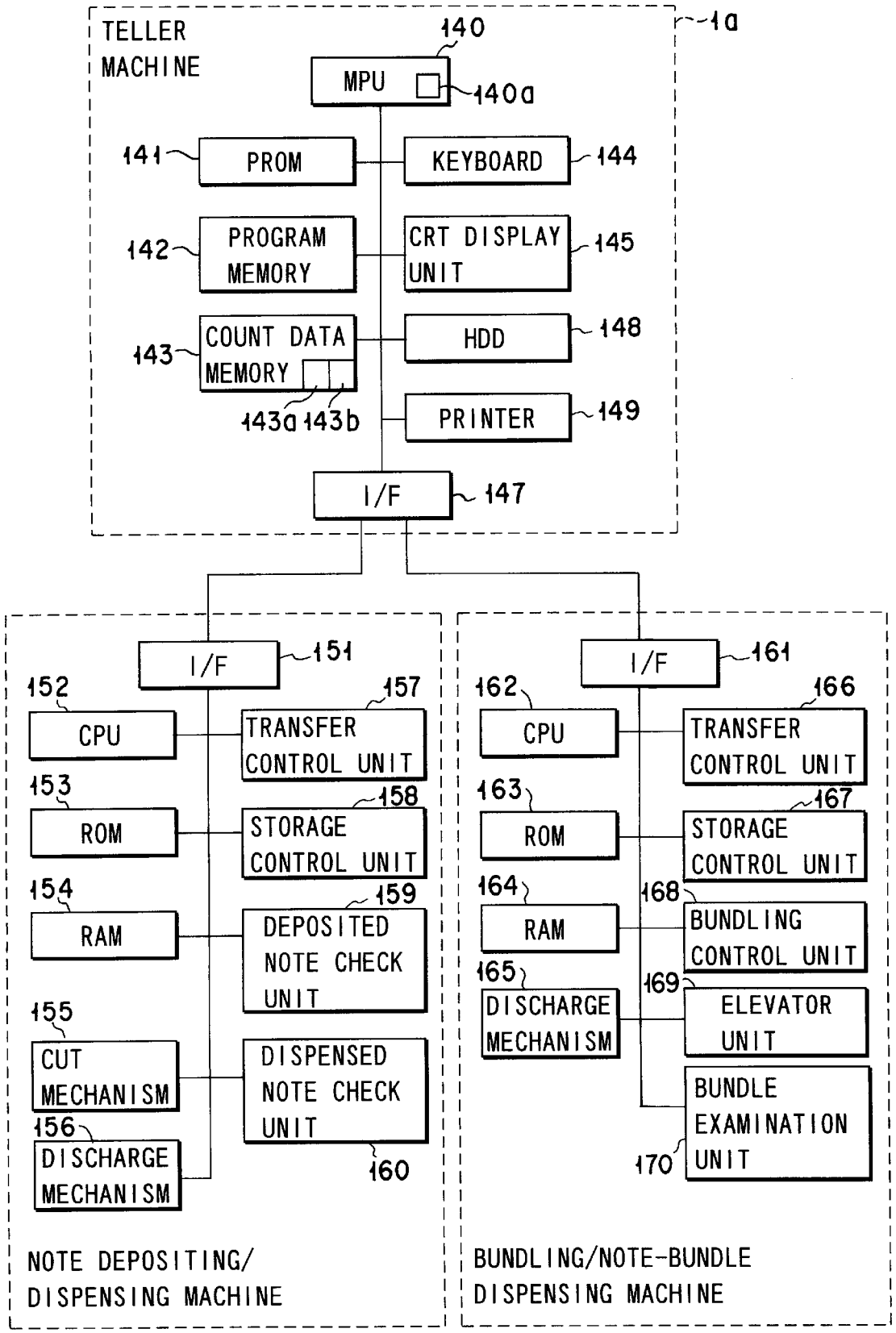
FIG. 9 is a block diagram showing a schematic structure of a control system in the system shown in FIG. 1.

Each of the four bundle boxes 83*a*–83*d* of the bundling/bundle dispensing machine 3 has the bundle count unit 112. The power supply for driving the bundle count unit 112 as well as signals and data transferred between bundle examination section 170 and CPU 162 shown in FIG. 9 are sent forth through a float connector 134 provided at the lower part of the bundle box 83*a*–83*d*, respectively.

As has been described above, the count sensor 113 comprises two reflection-type sensors 113*a* and 113*b* and is positioned to face the band S of the bundle P, as shown in FIG. 7. The count sensor 113 is vertically moved along the rail 114, and the brightness of the band S and the darkness of gaps among bands S of bundles P stacked in the bundle box 83*d* are sensed to determine the number of bundles P. The two reflection-type sensors 113*a* and 113*b* of count sensor 113 sense the bands S and gaps among the bundles P. Even if one of the two sensors 113*a* and 113*b* fails to sense a band S because of variance in position of band S on the bundle P, if the other sensor succeeds in sensing, the number of bundles can be determined, for example, by obtaining a logic OR of outputs of both sensors.

Irrespective of the kind of notes, the center of the band S is positioned, for example, at 30 mm from one end of the note bundle P. Accordingly, if the center of the band S is positioned at the midpoint between the two reflection-type sensors 113*a* and 113*b*, the range within which either reflection-type sensor 113*a*, 113*b* can sense the band S is increased even if the position of band S is slightly displaced.

There is a case where the positions of bands S are intentionally displaced for some reasons when bundles P are formed. For example, notes of 10,000 yen are bundled by the band S at 30 mm from one side of the notes, and notes of other kinds are bundled at 40 mm from one side thereof. Even if bundles, the positions of bands of which differ by 10 mm, are mixed, as mentioned above, the positions of the bands S can be exactly sensed if one of the reflection-type sensor, 113*a*, for example, is situated at a position corresponding to the position of band S at 40 mm from the end of the bundle, and the other reflection sensor 113*b* is situated at a position corresponding to the position of band S at 30 mm from the end of the bundle.

If the reflection-type sensors 113*a* and 113*b* are set to receive reflection light from the positions at 40 mm and 30 mm, they can sense only the bands S at the associated positions. If the reflection-type sensor 113*a* is set to receive reflection light from the position at 40 mm and the reflection-type sensor 113*b* is set to receive reflection light from positions at 40 mm and 30 mm, the reflection-type sensor 113*a* can sense only the bands at 40 mm and the reflection-type sensor 113*b* can sense both bands at 40 mm and 30 mm.

Even if the reflection-type sensor 113*a* cannot sense the bands at 40 mm, the other reflection-type sensor 113*b* can sense the bands both at 40 mm and 30 mm and the possibility of sensing error can be reduced.

In a case where note bundles P are stored in the box 84*d* without aligning the bands S and count sensor 113, both or either of the two reflection-type sensors of count sensor 113 may not sense the bands. In such a case, the thickness of the non-sensed bundles is determined from the distance of movement of the count sensor 113 detected by the encoder 124 and the number of bundles can be found by calculation operation using the determined distance. This technique will be described later in detail.

Figure 8:
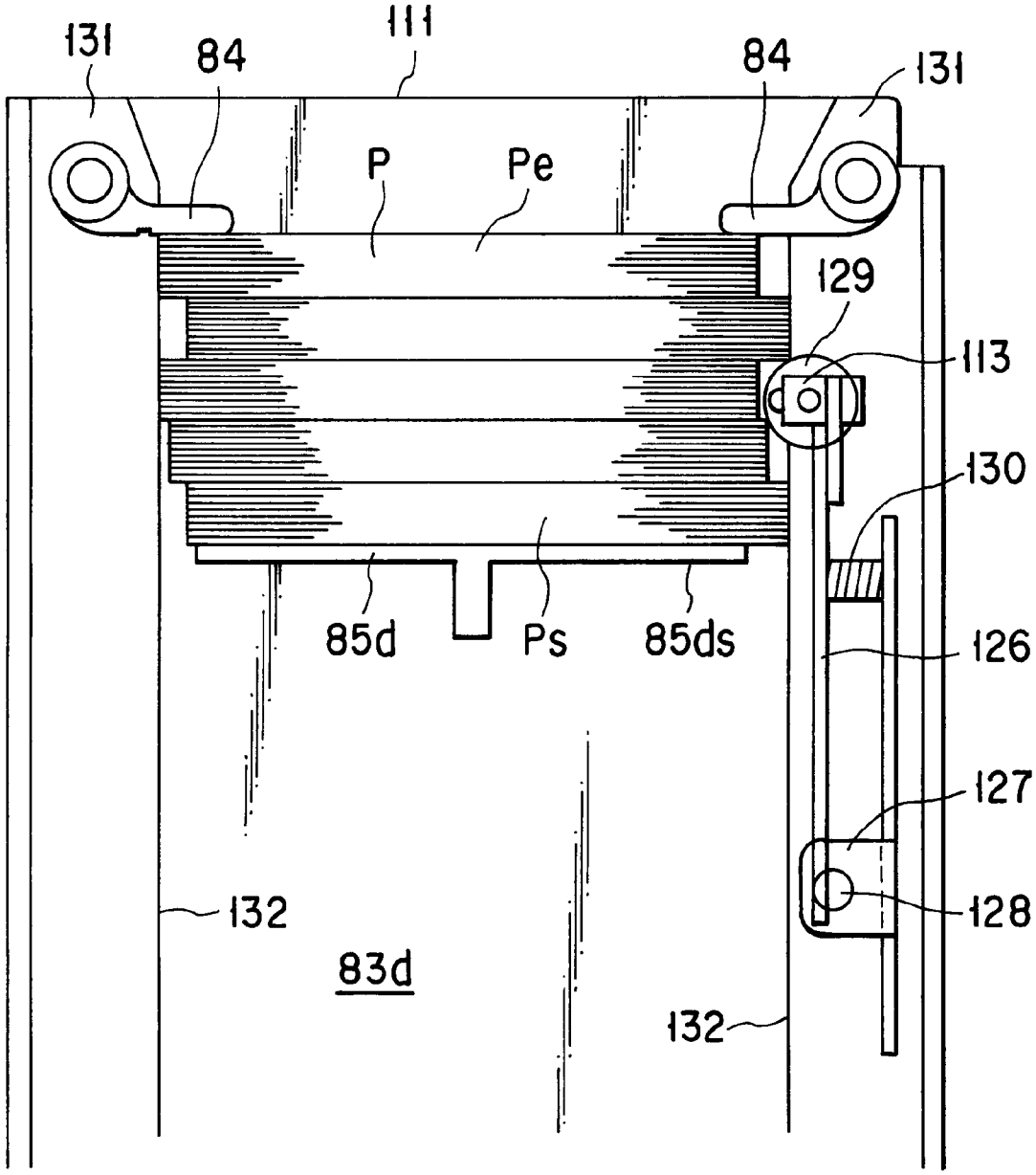
FIG. 8 is a side view showing a swinging mechanism of a counting sensor of the note bundle cashbox shown in FIG. 6.

Referring to FIG. 8, a description will now be given of a swinging mechanism for the count sensor 113 when the sensor 113 moves along the side faces of bundles P within the box 83*d*. FIG. 8 is a side view showing the swinging mechanism for the count sensor 113 and the bundles P stored in the bundle box 83*d*.

The count sensor 113 is fixed to a sensor bracket 126. The sensor bracket 126 can be rotated about a rotational shaft 128 at one end attached to a sensor base 127. The sensor bracket 126 is provided with a vertically rotatable roller 129 at the other end. A surface of the roller 129, which is directed to the bundles P, is positioned to slightly project from a distal end portion of a lens of the count sensor 113.

The sensor bracket 126 is urged by a compression coil spring 130 functioning as a resilient member attached to the sensor base 127 such that the roller 129 and count sensor 113 are pressed on the side faces of bundles P within the bundle box 83*d*.

The bundles P within the bundle box 84*d* are displaced back and forth, and right and left, within a range defined by ribs 131 and inner side walls 132. The roller 129 of the swinging mechanism moves in close contact with the bundles P in accordance with the shapes of bundles P displaced back and forth on the side facing the sensor 113 as shown in FIG. 8. Thus, an optimal lens focal distance is always kept between the count sensor 113 and the surface of the band S of the bundle P or the side face of the bundle P.

The inner side wall 132 of bundle box 84*d* can be fixed in position in accordance with the longitudinal dimensions of the respective kinds of notes or bundles. Thus, the right-and-left distance inside the box 83*d* can be restricted so that right-and-left displacement of respective kinds of bundles can be limited within a predetermined range.

Schematic structures of control systems of one of the teller machines, 1*a*, for example, the note depositing/dispensing machine 2 and the bundling/notebundle dispensing machine 3 will now be described with reference to the block diagram of FIG. 9. The control system of the other teller machine 1*b* has the same structure and is connected to the control systems of the note depositing/dispensing machine 2 and bundling/note-bundle dispensing machine 3 in the similar manner as the machine 1*a*.

In FIG. 9, the teller machine la includes an MPU 140 having a memory 140*a*. The MPU 140 is connected over a bus to a PROM 141, a program memory 142, a count data memory 143, a keyboard 144, a CRT display unit 145, an HDD 148 and a journal printer 149.

The MPU 140 is further connected to an I/F 147. The teller machine 1*a* is connected via the I/F 147 to an I/F 151 of the note depositing/dispensing machine 2 and an I/F 161 of the bundling/note-bundle dispensing machine 3.

In the note depositing/dispensing machine 2, the interface (I/F) 151 is connected to a CPU 152, a ROM 153, a RAM 154, a cut mechanism 155, a discharge mechanism 156 for discharging the notes stacked in the stacking section 61 to the bundling/note-bundle dispensing machine 3, a transfer control unit 157 for controlling the operation of the transfer path, a storage control unit 158 for controlling storage of notes in the storage boxes 48*a* to 48*d*, a deposited note check unit 159 including the check section 34, and a dispensed note check unit 160.

The CPU 152 controls the entirety of the note depositing/dispensing machine 2. The ROM 153 stores control programs for the CPU 152, etc. The RAM 154 is used to store various items of information or data relating to, e.g. notes checked in the note depositing/dispensing machine 2.

The transfer control unit 157 drives and controls the transfer path following the feed roller 29 on the basis of discrimination signals from the deposited note check unit 159 and dispensed note check unit 160, and thus the notes are transferred.

The storage control unit 158 drives and controls the sort gates (not shown), and thus the notes transferred on the transfer path are sorted into the temporary stack boxes 41*a* to 41*d* in accordance with discrimination signals from the check section 34. In addition, the storage control unit 158 moves and controls the shutters 47*a*–47*d*, thereby controlling storage of the notes stacked in the temporary stack boxes 41*a*–41*d* into the storage boxes 48*a*–48*d*. The storage control unit 158 drives and controls the take-out mechanism 56 including feed-out rollers, thereby taking out the notes from the storage boxes 48*a*–48*d* to the transfer path.

The I/F 151 is connected to the unit interface I/F 147 of teller machine 1*a*.

In the bundling/note-bundle dispensing machine 3, the I/F 161 is connected to a CPU 162, a ROM 163, a RAM 164, a discharge mechanism 165 for discharging note bundles from the bundle hand unit 71 to the bundling mechanism 91, a transfer control unit 166 for controlling the operations of the transfer paths 79 and 79A, a storage control unit 167 for controlling storage of bundles in the boxes 83*a*–83*d*, a bundling control unit 168 for controlling the operation of the bundling mechanism 91, an elevator unit 169 for controlling the elevator 87, and a bundle examination unit 170 (to be described later in detail) provided in the bundle boxes 83*a*–83*d*.

The CPU 162 controls the entirety of the bundling/note-bundle dispensing machine 3, and the ROM 163 stores control programs for the CPU 162, etc. The RAM 164 is used to store various items of information or data relating to, e.g. notes bundled in the bundling/note-bundle dispensing machine 3.

The transfer control unit 166 drives and controls the transfer paths including the transfer paths 79 and 79A shown in FIG. 4, whereby the note bundles are transferred from the bundling section 71. Under control of the bundling control section 168, the stacked notes fallen into the bundling section 91 from the temporary bundle box 72 are bundled with a band and thus note bundles are formed.

The transfer control unit 166 drives and controls the sorting gates (not shown). Thereby, the bundles transferred by the transfer path 79A are sorted into, e.g. the bundle storage box 84*d* in accordance with the designated kind of notes. In addition, the transfer control unit 166 drives and controls the take-out mechanism (not shown), whereby the bundles are taken out from each of storage boxes 83*a*–83*d* to the transfer path 79A.

The bundle examination unit 170 counts the number of bundles P stored in the storage boxes 83*a*–83*d*, respectively, and checks whether the count number coincides with the input amount.

FIG. 9 shows the state in which the note depositing/dispensing machine 2 and bundling/note-bundle dispensing machine 3 are connected to the teller machine 1*a*. Similarly, the machines 2 and 3 may be connected to the other teller machine 1*b* via the interfaces 151 and 161.

Referring now to FIGS. 10A, 10B through 15, a series of operations of the bundle examination unit 170 will now be described in association with the bundle box 84*d* shown in FIG. 6.

When the bundle examination is not performed, the count sensor 113 normally waits at the position of the lower end of the box 84*d* so as not to contact the bundle P placed on the back-up 85*d*. If additional bundles are loaded manually by the operator in this state, a request for examination of bundles is issued from, e.g. the teller machine 1*a*.

Figure 15:
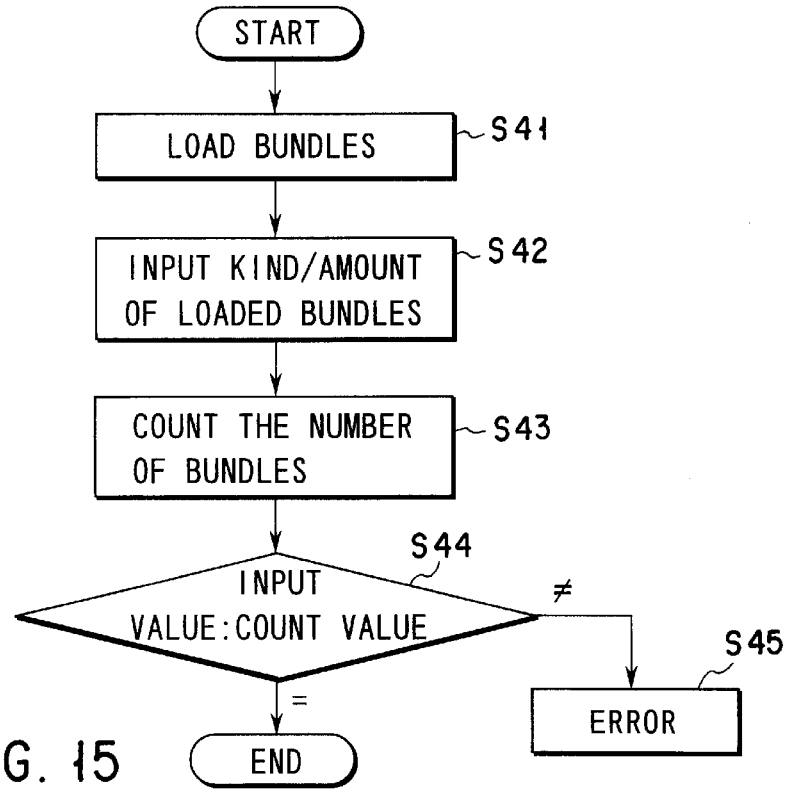
FIG. 15 is a flow chart illustrating an operation for collating the number of loaded note bundles with a count number of note bundles.

If the additional bundles are loaded in the box 83*d* in step S41 in FIG. 15, the kind and amount of the loaded bundles are input by the operator. Thereby, the total number of all bundles currently present in the box 84*d* is counted in step S43.

Figure 10A:
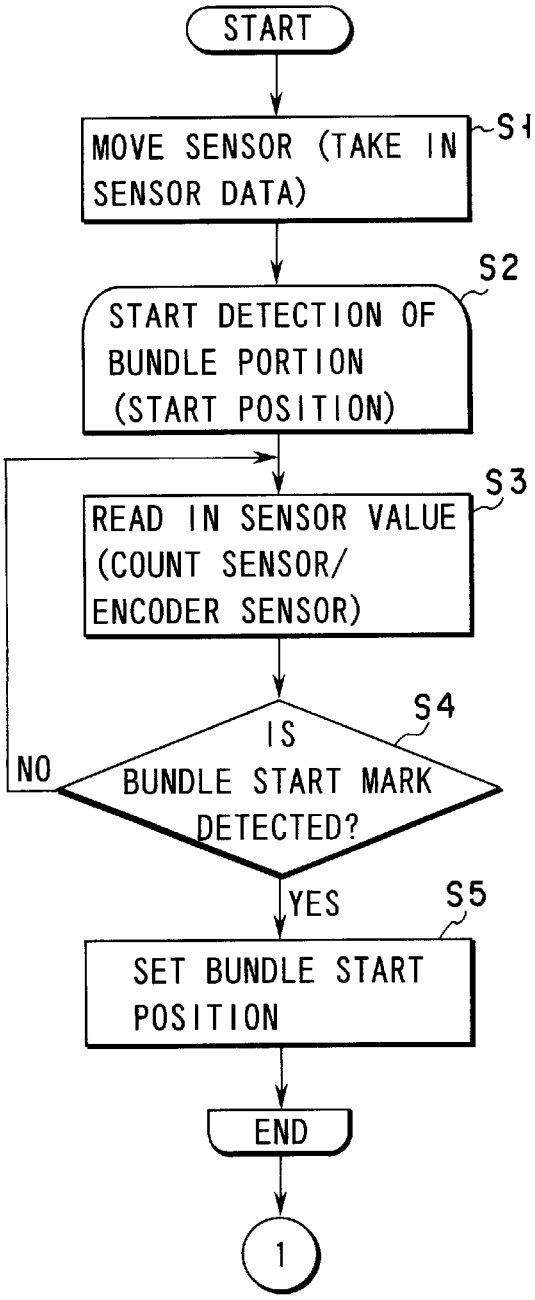
FIGS. 10A and 10B are flow charts illustrating an operation of the counting sensor of the note bundle cashbox shown in FIG. 6.

Specifically, the motor 121 of the bundle box 83*d*, for which the request for examination was made, is driven and in step S1 in FIG. 10A the encoder 124 is driven in step S1 and the count sensor 113 is raised. Thus, acquisition of sensor data is started. The acquired sensor data is successively stored in the RAM 164 under control of CPU 162 shown in FIG. 9.

In step S2, the detection of the portion of the bundle at the start position is started. While the count sensor 113 is rising, it begins to sense reflection light. In the example shown in FIG. 8, when the count sensor 113 rises and has come to the front of a support plate 85*ds* of the back-up 85*d*, the detection of the bundles is started. In step S3, outputs A and B of the count sensors 113*a* and 113*b* shown in FIGS. 12 and 13 and output data C of the encoder 124 is stored in the RAM 164.

Figure 12:
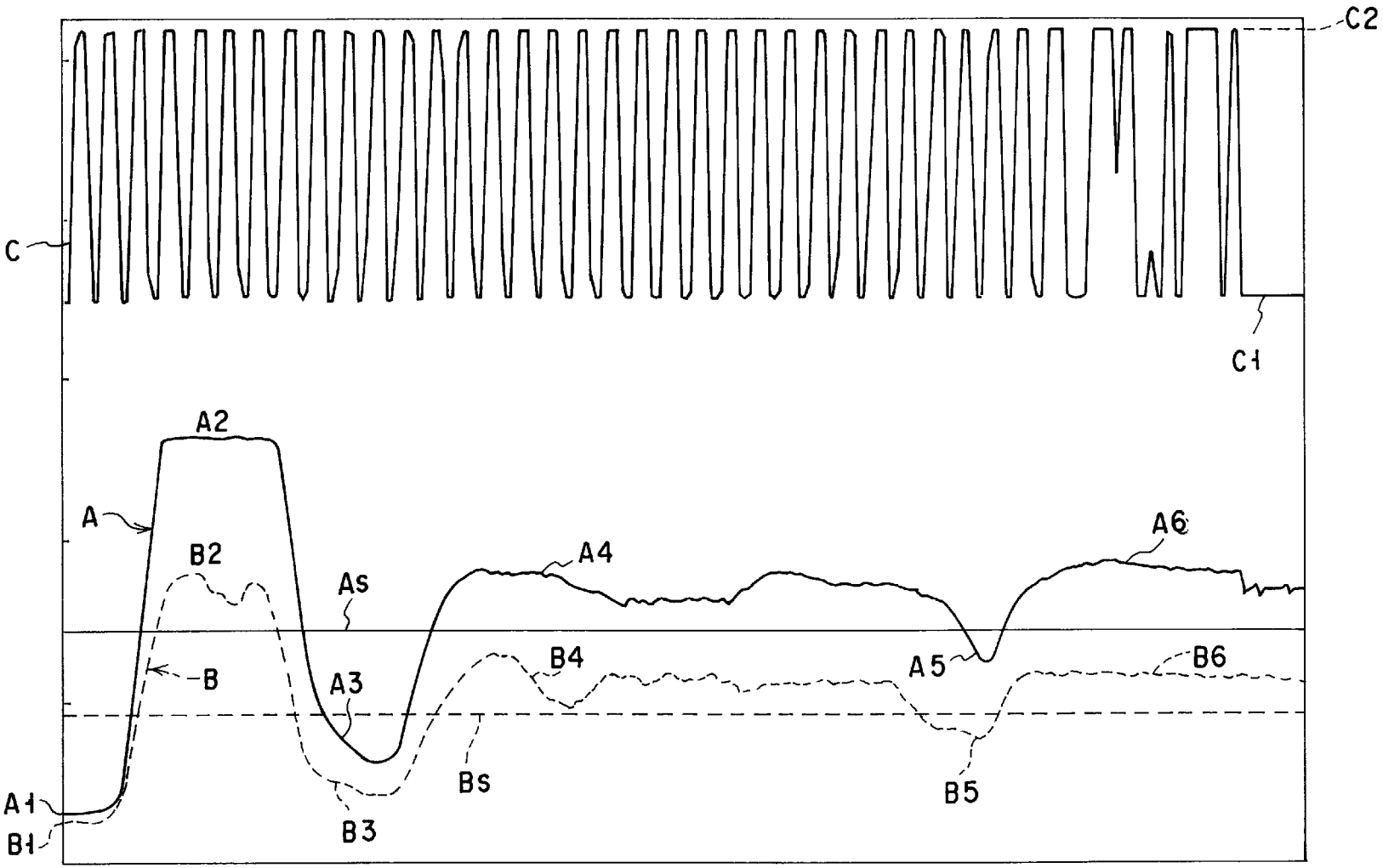
FIG. 12 is a graph showing output waveforms of the counting sensors of the note bundle cashbox shown in FIG. 6.
Figure 13:
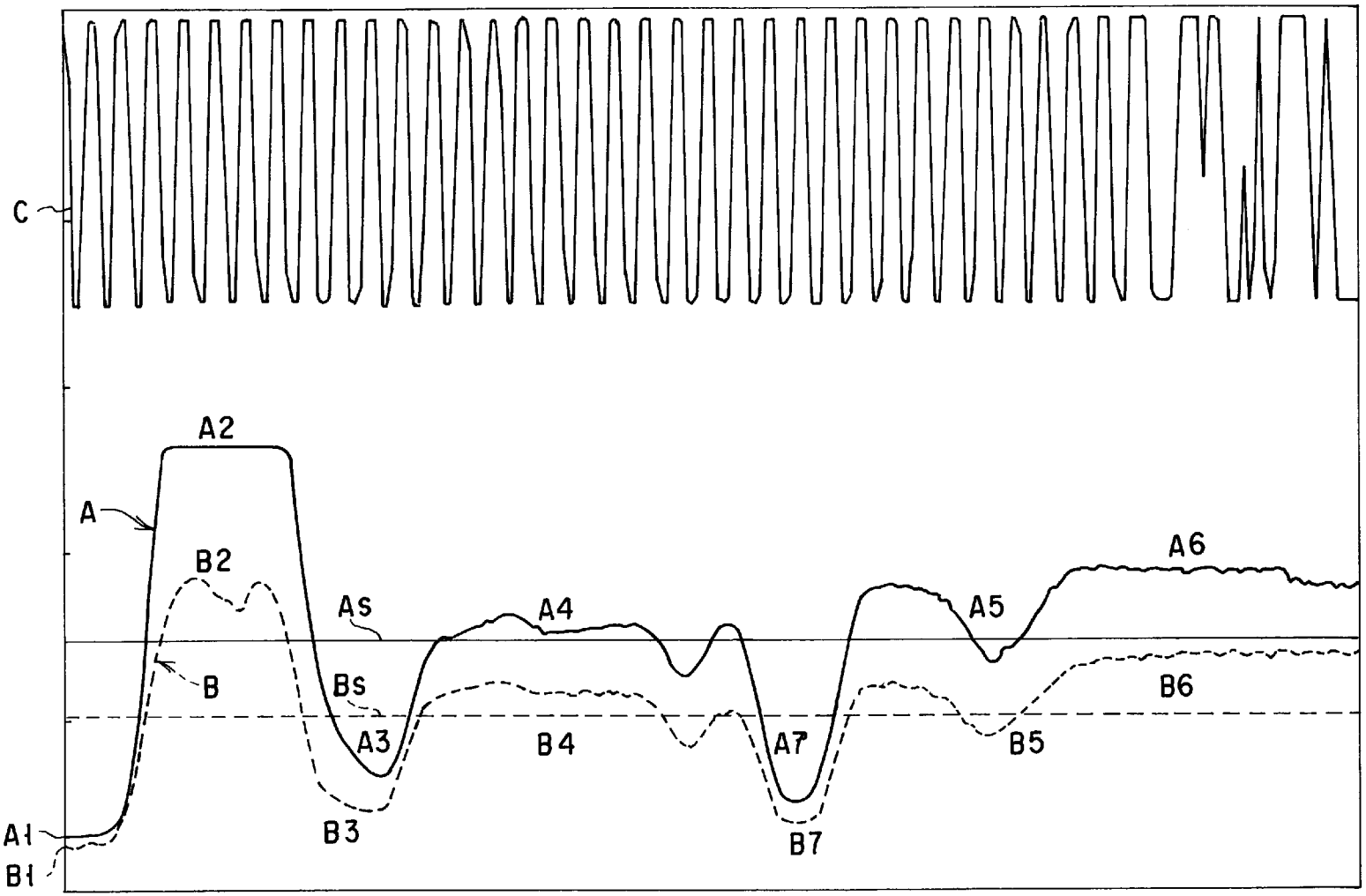
FIG. 13 is a graph showing output waveforms of the counting sensors of the note bundle cashbox shown in FIG. 6.

FIGS. 12 and 13 are graphs showing output waveforms of the sensors and associated output waveforms of the encoder 124 obtained by counting the number of note bundles P within the bundle box 83*d* while raising the count sensor 113.

Output levels A and B of the two sensors 113*a* and 113*b* of the count sensor 113 are kept low, as indicated by A1 and B1 in FIGS. 12 and 13, until the sensor 113, moving upward within the box 83*d*, reaches the back-up 85*d*.

In step S4, when an end mark or a bundle beginning mark (not shown) put on the back-up 85*d* is sensed, the output levels A and B rise to A2 and B2, as shown in FIGS. 12 and 13. Though described later, the levels A2 and B2 have values higher than slice levels As and Bs which are set for the outputs of sensors 113*a* and 113*b* in order to sense the bundles, respectively.

If the bundle beginning mark is sensed, the bundle beginning position is set in step S5, for example, by setting a flag on the RAM 164.

Figure 10B:
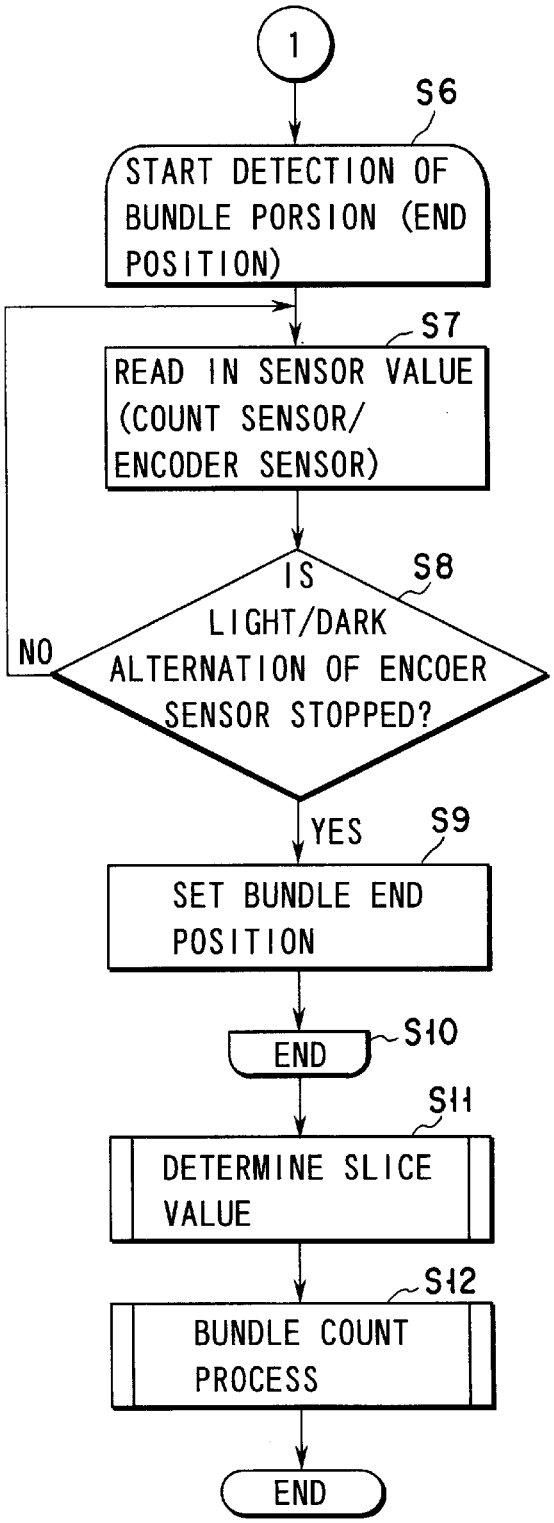

Following the setting of the bundle beginning position, the control goes to the processing of FIG. 10B. In step S6, a process for sensing the end position, i.e. the uppermost bundle P, is started. With the beginning of this process, output data items A, B and C of the count sensors 113*a* and 113*b* and encoder 124 are continuously stored in the RAM 164 in step S7.

As the sensor 113 is rising subsequently, output data items A and B varying in level, as shown in FIGS. 12 and 13, are obtained from the two sensors 113*a* and 113*b*. At the same time, a continuous pulse output C with a substantially constant amplitude is obtained from the encoder 124.

Specifically, the two sensors 113*a* and 113*b* of the count sensor 113 are reflection-type sensors. Since no light is reflected from the region where the bundle P is absent in the bundle box 83*d*, output voltages of the sensors 113*a* and 113*b* are low in such a case, as indicated by A1 and B1 in FIG. 12. The reflection light, however, increases in the vicinity of the back-up 85*d* having the end mark and the output voltages increase, as indicated by A2 and B2.

If the count sensor 113 moves away from the back-up 85*d*, reflection light is lost and the output voltages of the sensors 113*a* and 113*b* temporarily drop, as indicated by A3 and B3. If the sensor 113 reaches the position of the first bundle Ps, reflection light is increased by the presence of the band S and the output voltages of the sensors increase, as indicated by A4 and B4. Further, if the count sensor 113 moves and reaches a boundary between the bands, the reflection light decreases at the boundary and the output voltages of the sensors 113*a* and 113*b* decrease, as indicated by A5 and B5.

When the count sensor 113 further moves and reaches the band S of the next bundle P, the reflection light is increased once again by the band S and the output voltages of the sensors 113*a*, 113*b* increase, as indicated by A6 and B6 in FIG. 12.

If the output of the encoder 124 becomes constant in this state, for example, at level C1, as shown at a right end portion of FIG. 12, the stop of the encoder 124 is detected in step S8. In a case where the encoder 124 is of a slit transmission type, the output may become constant at high level C2.

At this time, the sensor 113 stops at a position where it screens the upper-end sensor 119 in FIG. 6.

If the stop of the encoder 124 is detected in step S8, the sensor 113 is positioned at the uppermost bundle Pe. In this state, the bundle end position is set in step S9 and the process is finished in step S10.

In this state, the output levels of the sensors 113*a* and 113*b*, which are stored in the RAM 164, are checked in step S11, and levels As and Bs, at which the sensor output levels associated with the band S of the bundle P, e.g. levels A3 and B3 in FIG. 12, can be exactly sensed, are determined as slice levels and stored in the RAM 164.

In subsequent step S12, the data stored in the RAM 164 is read out and the number of stacked bundles P is determined on the basis of the detected end mark of the back-up 85*d*, the number of light/dark alternations occurring between bands of bundles P and the number of pulses measured by the encoder 124. Thus, the bundle counting process is finished.

Since the four bundle boxes 83*a* to 84*d* of the bundling/note-bundle dispensing machine 3 have the same mechanisms, it is possible to examine only the bundles in the desired bundle box upon request from the teller machine 1*a* or 1*b*, or to examine the bundles in all the bundle boxes at a time.

The bundle count process in step S12, that is, the method of determining the number of bundles on the basis of the output data from the sensor 113 and encoder 124, will now be described with reference to FIGS. 11 to 14.

Figure 11:
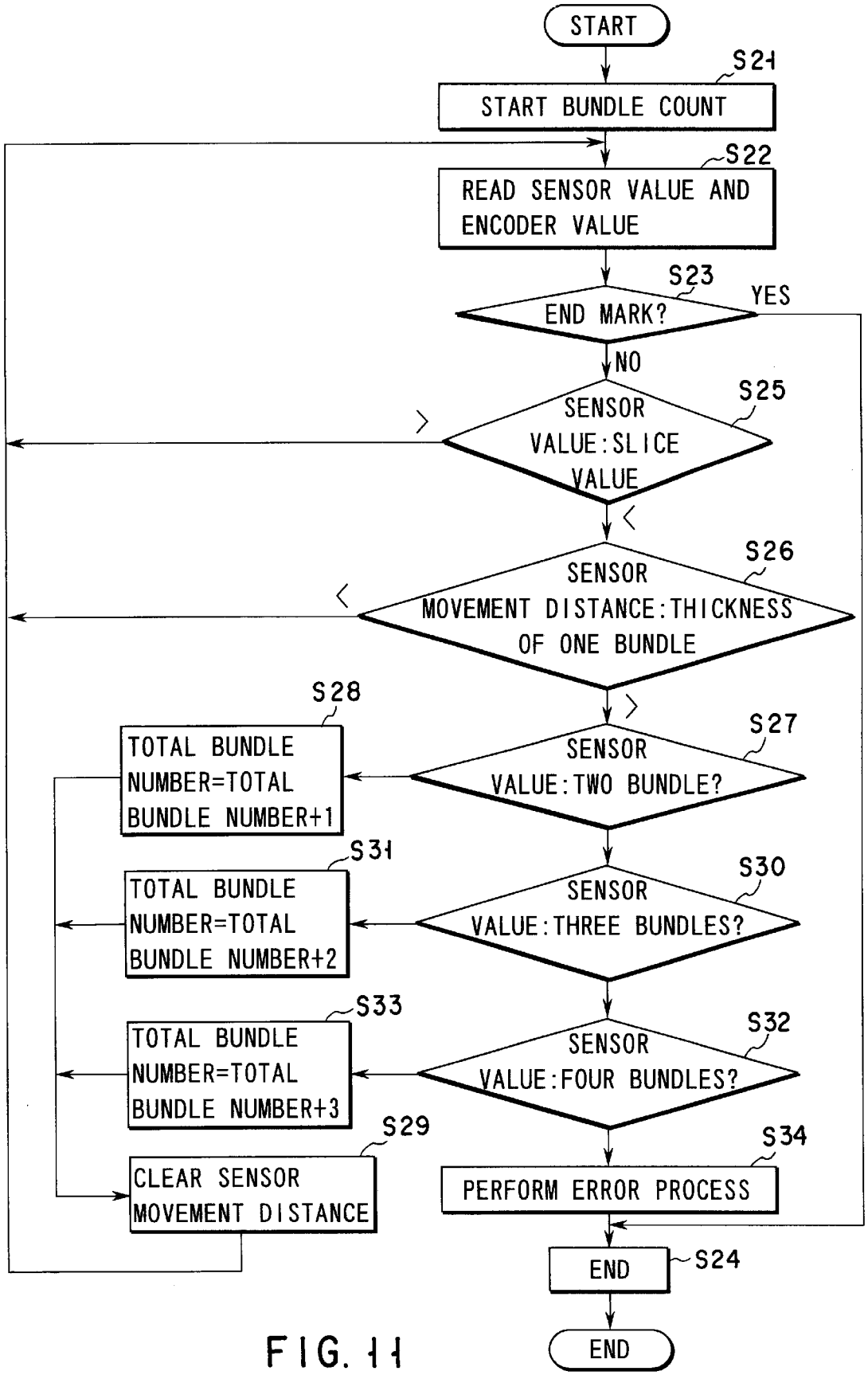
FIG. 11 is a flow chart illustrating an operation of the counting sensor of the note bundle cashbox shown in FIG. 6.

In the following description associated with FIG. 11, the output data from the sensor 113, which is stored in the RAM 164, is read out in an order reverse to the order for data write, and thus the number of bundles is counted. As a matter of course, however, the data may be read out in the order of data write.

In step S21, the bundle examination unit 170 performs a bundle number count start process in step S21 under control of CPU 162. In step S22, the sensor values A and B of the sensor 113 and the encoder value C of the encoder 124, which are stored in the RAM 164, are read.

In this case, the data is reversely read out from the RAM 164. It is thus supposed, e.g. in FIG. 12, that the sensor data on levels A6 and B6 have been first read out. At the same time, in the processing illustrated in FIGS. 10A and 10B, the stored slice level values As and Bs and average thickness data on the note bundle P of 100 new notes are read out.

The levels A6 and B6 are checked in step S23. Since the levels A6 and B6 are lower than the end mark levels A2 and B2, the control goes to step S25. If the end mark levels A2 and B2 are detected, the control goes to step S24 and the "END" step is carried out.

In step S25, the sensor values A6 and B6 are compared with the slice values As and Bs. In this case, since the sensor values are greater, the control returns to step S22.

When the sensor levels A5 and B5 are read out, the slice values As and Bs are greater than these levels and the control goes to step S26. In step S26, the sensor movement distance data represented by the encoder value C is compared with the read-out reference thickness data of the bundle P.

If the thickness data is greater, the control returns to step S22. If the data representing the sensor movement distance is greater than the reference thickness data, the control goes to step S27 and a division operation is performed to find the number of times by which the sensor movement distance value data is greater than the reference thickness of one bundle.

If the sensor value is twice or less, the control goes to step S28. In step S28 "1" is added to the total number of bundles detected thus far and the updated total number is stored. The encoder value indicating the sensor movement distance until that time is cleared and the control goes back to step S22.

Similarly, if the sensor value is more than twice and less than thrice, the control goes from step S27 through step S30 to step S31 and "2" is added to the total number of bundles detected thus far. The updated total number of bundles is stored, the encoder value indicating the sensor movement distance until that time is cleared, and the control returns to step S22.

If the sensor value is more than thrice and less than four times, the control goes from step S30 through step S32 to step S33, and "3" is added to the total number of bundles detected until that time. The updated total number of bundles is stored, the encoder value indicating the sensor movement distance until that time is cleared, and the control returns to step S22.

If it is detected in step S32 that the sensor value is more than four times the reference bundle thickness, an error process is executed in step S34 because a difference in thickness between the four bundles of new notes and the four bundles of circulated notes increases up to a value near to the bundle thickness and there arises a possibility of erroneous counting. Then in step S24 the process for ending the bundle number count process is executed.

Referring to FIG. 12, if sensor values A4 and B4 and then sensor values A3 and B3 are obtained after sensor value A5 and B5 were read out, the sensor movement distance during this time indicates just the thickness of one bundle, the control advances from step S27 to steps S28 and S29.

However, if there is some stain, for example, on the side of the band of the bundle, low values A7 and B7 may possibly be read immediately after the sensor values A5 and B5 are read out, as shown in FIG. 13.

In such a case, the sensor movement distance between A5 and A7 and that between B5 and B7 are less than the thickness of the reference bundle. Thus, the control returns from step S26 to step S22, and the region associated with this distance is not erroneously recognized as one bundle.

In FIGS. 12 and 13, if the sensor values A2 and B2 associated with the end mark on the back-up 85*d* are read out, it is detected in step S23 that all bundles are read. The control goes to step S24 and the process is completed.

In this manner all bundles P within the bundle box 83*d* are counted. If waveform components, each of which comprises portions corresponding to high output voltages associated with the bands S and portions corresponding to low output voltages associated with the boundaries between the bands S, are obtained by a number equal to the number of bundles P, the determination of the number of bundles P is completed.

Figure 14:
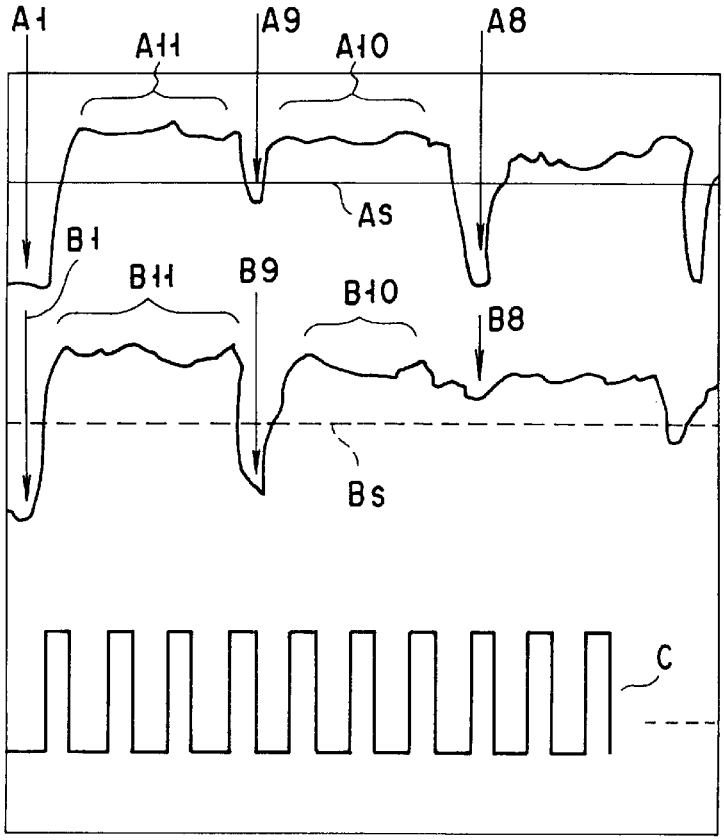
FIG. 14 is a graph showing further output waveforms of the counting sensors of the note bundle cashbox shown in FIG. 6.

During the bundle counting process, the sensor 113*a* reads the boundary between bands and accordingly a sensor value A8 in FIG. 14 indicates a low output voltage. However, the associated sensor value B8 of sensor 113*b* indicates no output voltage variation lowering to the level under the slice level Bs because the sensor 113*b* is unable to read the boundary between bands.

In such a case, the low output portion A8 of the sensor 113*a* can be determined to correspond to the boundary between bands on the basis of the sensor movement distance detected by the encoder 124. By the method described in steps S27 and S28 in FIG. 11, too, one bundle can be counted.

In FIG. 14, a portion A10 between sensor values A8. and A9 and a portion A11 between sensor values A9 and A1, which are higher than the slice value As, can be counted as one bundle, respectively. In this case, the count result can be confirmed by using, as reference values, the sensor values B8 to B11 as well as the value B1 of the sensor 113*b*.

If the number of bundles in the box 84*d* has thus been counted in step S43, the control goes to step S44 in FIG. 15 and the number of bundles, which was input previously by the operator, is compared with the actually counted number of bundles. In case of non-coincidence, an error process is performed in step S45 and, for example, this state is displayed on the CRT display unit 145 where necessary. In case of coincidence, the number of bundles is determined and the count value is ensured.

The note-bundle kind discrimination function will further be described with reference FIG. 4.

The reflection-type note-kind discrimination sensor 133 is disposed near the exit of the bundle transfer path 79A. When bundles P are discharged for cash dispensing or other transactions, two or more locations on the surface of the bundle P, which is passing through the exit of the bundle transfer path 79A, are sensed by the note-kind discrimination sensor 133. The kind of the dispensed or discharged bundle is discriminated by recognizing the reflection pattern.

Examples of transactions using the above-described note bundle management apparatus will now be described.

In the case of a deposit transaction, cash to be deposited is set in the note inlet 11 of the note depositing/dispensing machine 2. Then, for example, from the teller machine 1*a*, a note take-in start operation is performed. As a result, the note depositing/dispensing machine 2 starts counting of the notes and, after the counting, transmits the count result to the teller machine 1*a*.

The operator, who is performing the deposit operation, inputs deposit data, such as the amount on a slip or a deposit number, by using operation keys included in the keyboard 144 of the teller machine 1*a* while the notes are being counted. If the count result from the note depositing/dispensing machine 2 coincides with the amount on the slip, the operator depresses a completion button and finishes the deposit transaction. The content of the transaction is stored in the count data memory 143 in the teller machine 1*a* and recorded by the attached journal printer 149.

In the case of a dispensing operation, the operator inputs cash dispensing data, such as the amount to be dispensed or a deposit number, from the keyboard 144 of the teller machine 1*a* and depresses a start key. In response to a cash dispensing request from the teller machine 1*a*, the note depositing/dispensing machine 2 is activated and notes are taken out of the storage boxes 48*a*–48*d* and transferred to the note outlet 14. If the cash dispensing request is associated with note bundles, one or more bundles are dispensed from the cash dispense door 24 of the bundling/note-bundle dispensing machine 3.

In case jam has occurred in the machine during the note dispensing process, the rank of the operator is identified from his/her ID card inserted in the teller machine 1*a* since the notes present on the transfer path are still those requiring management within the machine. If the operator is in the rank capable of handling the notes within the machine, the electromagnetic lock of the cash dispensing mechanism is released and a jam releasing operation by the operator is awaited. If the operator is in the low rank and is not permitted to handle cash within the machine, an operator in a high rank is demanded and the insertion of his/her ID card is awaited.

With this control, the security of the cash within the machine is ensured and the person who has handled the cash can be identified.

If the cash deposit process is repeated and the notes are stacked in the storage boxes 48*a*–48*d*, the note depositing/dispensing machine 2 performs a process to automatically deliver the notes within the storage boxes 48*a*–48*d* to the bundling section. With this process, the amount of notes in the storage boxes 48*a*–48*d* is kept substantially constant, i.e., less than 100, and excess notes are stored in the unit of 100 in the note bundle boxes 83*a*–83*d*.

As has been described above in detail, the present invention can provide a bundled sheets managing apparatus with the functions of easily and exactly counting and determining the number of bundles of sheets such as banknotes stored in the sheet storage box such as a cashbox.

Additional advantages and modifications will readily occur to those skilled in the art. Therefore, the invention in its broader aspects is not. limited to the specific details and representative embodiments shown and described herein. Accordingly, various modifications may be made without departing from the spirit or scope of the general inventive concept as defined by the appended claims and their equivalents.

What is claimed is:

1. A note bundle managing apparatus comprising:

a storage box for storing note bundles each formed by bundling a predetermined number of notes;

bundle counting means provided within the storage box to be movable over an entire length in a direction of stacking of the note bundles stored within said storage box; and means for moving the bundle counting means in the direction of stacking of the note bundles, said bundle counting means including detection means for detecting a band, which bundles each of the note bundles, while being moved by the moving means in the direction of stacking the note bundles, the detection means having a photoelectric detection means for detecting a difference in reflectance of light between each band and a gap between bands to generate an electric signal.

2. The note bundle managing apparatus according to claim 1, wherein the photoelectric detection means includes at least two optical sensors juxtaposed with a predetermined interval in a direction perpendicular to a direction of movement of the photoelectric detection means.

3. The note bundle managing apparatus according to claim 2, wherein the at least two optical sensors are provided in association with a first band provided for bundling at a first position and a second band provided for bundling at a second position of the note bundle.

4. The note bundle managing apparatus according to claim 2, wherein at least one of the at least two optical sensors is positioned to detect both a first band at a first position of a note bundle and a second band at a second position of the note bundle.

5. The note bundle managing apparatus according to claim 1, wherein the bundle counting means comprises:

comparing means for delivering an output when a level of an output signal from the photoelectric detection means has exceeded a predetermined reference level; and means for counting the output from the comparing means to count the number of note bundles.

6. The note bundle managing apparatus according to claim 1, further comprising:

means for stacking the predetermined number of notes;

means for bundling the stacked notes and thus forming a note bundle; and means for storing the formed note bundle in the storage box.

7. The note bundle managing apparatus according to claim 1, further comprising:

means for inputting data representing a number of note bundles manually loaded in the storage box; and collation means for determining whether the number of note bundles, which was input by the means for inputting, coincides with a number of note bundles which was counted by the bundle counting means.

8. The note bundling managing apparatus according to claim 1, further comprising:

means for taking out the note bundles from the storage box;

means for transferring note bundles taken out by said means for taking; and means, provided on the transferring means, for detecting a kind of the note bundles transferred on the transferring means.

9. A note bundle managing apparatus comprising:

a storage box for storing, in a stacked manner, note bundles each formed by bundling a predetermined number of notes;

bundle counting means provided within the storage box and moved in a direction of stacking of the note bundles to count a number of note bundles;

distance detection means for detecting a distance over which the bundle counting means has moved along the note bundles stacked within the storage box;

calculation means for calculating a number of the stored note bundles corresponding to the distance of movement of the bundle counting means within the storage box which has been detected by the distance detection means; and determination means for determining a number of note bundles stored in the storage box on the basis of the bundle counting means, the distance detection means, and the calculation means.

10. The note bundle managing apparatus according to claim 9, wherein the determination means includes means for determining the number of note bundles stored in the storage box by complementing the number of note bundles, which was counted by the bundle counting means, with the number of note bundles which was calculated by the calculation means.

11. The note bundle managing apparatus according to claim 9, wherein the bundle counting means includes means for sensing bands which bundle the note bundles, and counting the number of bundles corresponding to the number of the sensed bands, and the calculation means includes means for calculating the number of note bundles corresponding to the distance of movement of the bundle counting means at a time when the bands are sensed and a thickness of a reference note bundle.

12. The note bundling managing apparatus according to claim 9, wherein the bundle counting means includes an optical sensor for outputting a first sensor signal with a first level associated with a band and a second sensor signal with a second level associated with a gap between bands, and means for comparing the first and second levels with a slice level set between the first and second levels, the calculation means includes comparison means for detecting that a distance of movement of the optical sensor is greater than a distance of movement corresponding to a thickness of one of the note bundles, when the optical sensor has output the second sensor signal with the second level after outputting the first sensor signal with the first level, means for obtaining a value of a ratio between the distance of movement of the optical sensor and the distance of movement corresponding to the thickness of one of the note bundles, and means for determining an integer component of the value of the ratio to be the number of note bundles, and said determination means includes means for adding the integer component of the value of the ratio to a count result of the bundle counting means to obtain an updated bundle count value.

13. The note bundle managing apparatus according to claim 9, wherein the bundle counting means has a sensor movable along side faces of the note bundles, and the distance detection means includes an encoder for detecting a distance of movement of the sensor.

14. The note bundle managing apparatus according to claim 13, wherein the encoder includes means for producing a pulse signal of which the number of pulses corresponds to the distance of movement of the sensor.

15. The note bundle managing apparatus according to claim 13, further comprising memory means for storing output data of the sensor, along with an output of the distance detection means, over the entire range of movement of the sensor within the storage box, and control means for controlling a storage operation of the memory means.

16. The note bundle managing apparatus according to claim 15, wherein the control means includes means for determining a slice value serving as a reference for counting the number of note bundles.

17. The note bundle managing apparatus according to claim 16, wherein the control means reads out and compares the determined slice value and the sensor output data stored in the memory means and supplies a comparison result to the bundle counting means to count the number of note bundles.

18. The note bundle managing apparatus according to claim 15, wherein the control means includes means for calculating the number of note bundles only when a quotient obtained by dividing the distance of movement of the sensor by the thickness of one note bundle is three or less.

19. A note bundling managing apparatus comprising:

a storage box for storing, in a stacked manner, note bundles each formed by bundling a predetermined number of notes;

bundle counting means provided within the storage box and moved in a direction of stacking of the note bundles to count the number of the note bundles;

movement amount detection means for detecting an amount of movement of the bundle counting means within the storage box;

calculation means for calculating a number of the stored note bundles corresponding to the movement amount of the bundle counting means within the storage box which is detected by the movement amount detection means; and means for determining a number of note bundles stored in the storage box corresponding to the number of bundles obtained by the bundle counting means and the number of bundles obtained by the calculation means, wherein the calculation means includes means for calculating a number of bundles corresponding to a distance of movement of the bundle counting means at a time when the band is detected and the thickness of one note bundle.

20. The note bundle managing apparatus according to claim 19, wherein the bundle counting means has a sensor movable along side faces of the note bundles, and the apparatus further comprises memory means for storing output data of the sensor, along with an output of the movement amount detection means, over the entire range of movement of the sensor within the storage box, and control means for controlling a storage operation of the memory means.

21. The note bundle managing apparatus according to claim 20, wherein the control means includes means for determining a slice value serving as a reference for counting the number of note bundles.

22. The note bundle managing apparatus according to claim 21, wherein the control means compares the determined slice value and the sensor output data stored in the memory means and supplies a comparison result to the bundle counting means to count the number of note bundles.

23. A note processing apparatus comprising:

a note bundle dispenser having a plurality of bundle boxes for stacking and storing note bundles formed by bundling notes with bands, a bundle number counting apparatus provided for each of the bundle boxes, and moved in a direction of stacking of the note bundles to count the number of note bundles, and means for moving the bundle counting means in the direction of stacking of the note bundles, said bundle number counting apparatus including detection means for detecting a band of each note bundle, while being moved by the moving means in the direction of stacking of the note bundles, the detection means having a photoelectric detection means for detecting a difference in reflectance of light between each band and a gap between bands of the stored note bundles to generate an electric signal;

an operation display apparatus for inputting operational instructions to the note bundle dispenser and displaying an operation result; and means for operating, when the operation display apparatus has instructed an examination of the number of note bundles in the bundle boxes, the bundle number counting apparatuses of all the bundle boxes which have been instructed to perform the examination.

24. The note processing apparatus according to claim 23, wherein the operation display apparatus includes means for displaying, at a time, results of examination of the number of note bundles in all the bundle boxes which have been instructed to perform the examination.

25. The note processing apparatus according to claim 23, wherein each of the bundle number counting apparatuses includes a pair of reflection-type optical sensors, a movement distance measuring device for measuring a movement amount of each of the sensors, and means for counting a number of note bundles in the bundle boxes corresponding to at least one of an output of the bundle number counting apparatus and an output of the movement distance measuring device.

* * * * *